US012714201B2

(12) United States Patent
Long et al.

(10) Patent No.: US 12,714,201 B2
(45) Date of Patent: Aug. 25, 2026

(54) ADJUSTABLE ELEMENT FOR ARTICLE OF FOOTWEAR

(71) Applicant: NIKE, Inc., Beaverton, OR (US)

(72) Inventors: Nicholas R. Long, Portland, OR (US); Todd W. Miller, Portland, OR (US); Matthew D. Nordstrom, Portland, OR (US); Richard Kristian Hansen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 182 days.

(21) Appl. No.: 18/484,356

(22) Filed: Oct. 10, 2023

(65) Prior Publication Data

US 2024/0115006 A1 Apr. 11, 2024

Related U.S. Application Data

(60) Provisional application No. 63/414,973, filed on Oct. 11, 2022.

(51) Int. Cl.

| | |
|---|---|
| ***A43B 23/02*** | (2006.01) |
| ***A43B 3/26*** | (2006.01) |
| ***A43C 11/00*** | (2006.01) |

(52) U.S. Cl.

CPC ..... *A43B 23/029* (2013.01); *A43B 3/26* (2013.01); *A43B 23/0235* (2013.01); *A43C 11/00* (2013.01)

(58) Field of Classification Search

CPC ..... A43B 23/029; A43B 13/203; A43B 3/26; A43B 23/0235; A43C 11/008; A43C 11/00

See application file for complete search history.

(56) References Cited

U.S. PATENT DOCUMENTS 3,552,044 A * 1/1971 Wiele ..... A42B 3/127 36/117.6
3,745,998 A * 7/1973 Rose ..... A61F 5/055 5/625
4,633,529 A * 1/1987 Litz ..... A63B 71/1225 2/24

(Continued)

FOREIGN PATENT DOCUMENTS

WO WO-2021080970 A1 4/2021

OTHER PUBLICATIONS

European Patent Office (ISA), International Search Report and Written Opinion for PCT App. No. PCT/2023/076524, mailed Feb. 6, 2024.

*Primary Examiner* — Jameson D Collier
(74) *Attorney, Agent, or Firm* — Honigman LLP; Matthew H. Szalach

(57) ABSTRACT

An article of footwear includes an adjustable element. The adjustable element includes a bladder that defines an interior void. A compressible component that is disposed within the interior void and is operable between an expanded state and a contracted state. The adjustable element also includes a lock strip including a first end anchored at a first location within the bladder and a second end disposed at an opposite end of the lock strip than the first end. A lock receives the lock strip and is operable between a locked state restricting movement of the lock strip relative to the bladder and an unlocked state permitting movement of the lock strip relative to the bladder.

20 Claims, 25 Drawing Sheets

(56) References Cited

U.S. PATENT DOCUMENTS

| | | | | |
|---|---|---|---|---|
| 4,657,003 | A * | 4/1987 | Wirtz | A61F 5/05833 128/869 |
| 5,392,534 | A | 2/1995 | Grim | |
| 5,617,650 | A * | 4/1997 | Grim | A43B 7/147 36/154 |
| 5,713,141 | A | 2/1998 | Mitchell et al. | |
| 5,952,065 | A | 9/1999 | Mitchell et al. | |
| 6,582,786 | B1 | 6/2003 | Bonk et al. | |
| 11,576,468 | B2 * | 2/2023 | Panian | A43C 11/004 |
| 12,127,608 | B2 * | 10/2024 | Casillas | A41C 3/105 |
| 12,329,238 | B2 * | 6/2025 | Panian | A43C 11/004 |
| 12,376,642 | B2 * | 8/2025 | Bishop | A43B 23/0245 |
| 12,433,370 | B2 * | 10/2025 | Bishop | A43C 11/008 |
| 2019/0021717 | A1 | 1/2019 | Corrigan et al. | |
| 2021/0120915 | A1 * | 4/2021 | Panian | A43B 3/26 |
| 2022/0104582 | A1 * | 4/2022 | Christensen | A43B 13/203 |
| 2022/0330657 | A1 * | 10/2022 | Bishop | A43C 11/008 |

* cited by examiner

FIG. 12
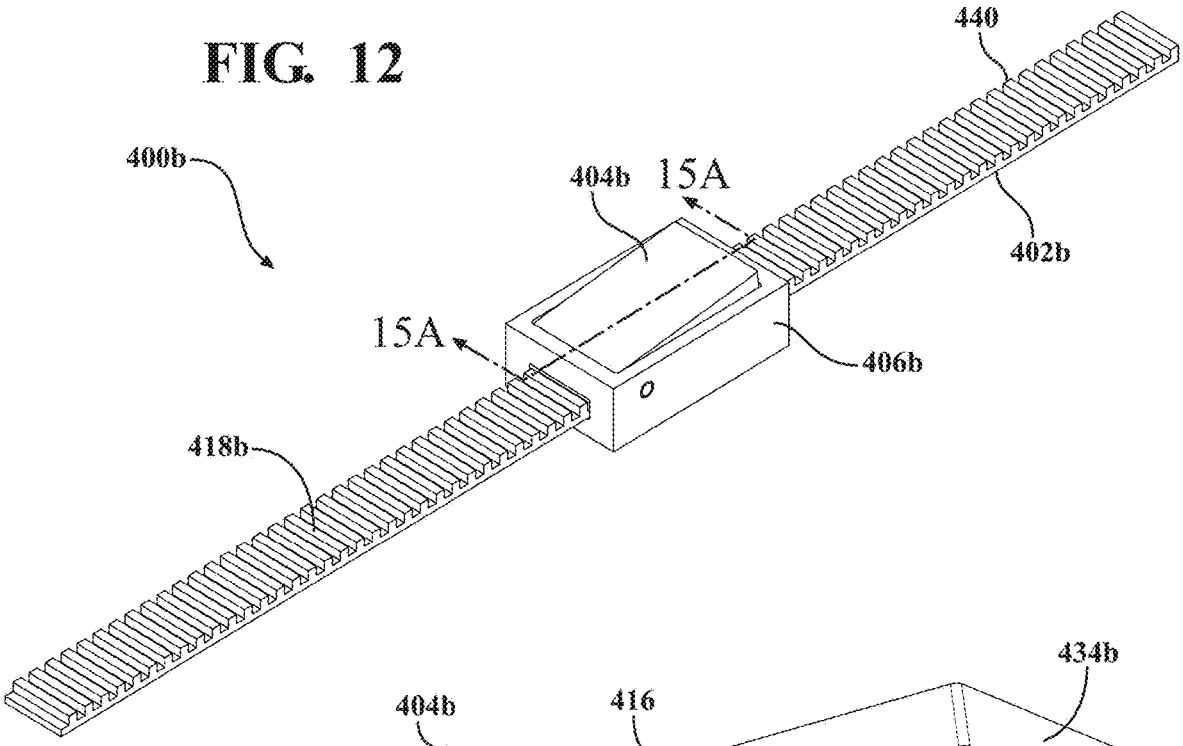
FIG. 13
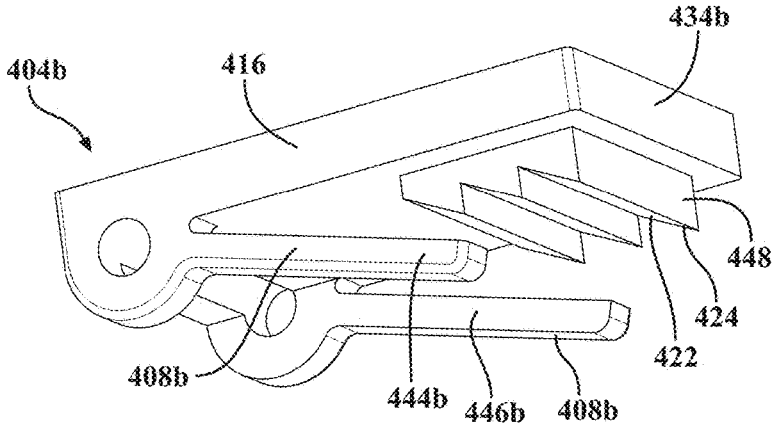
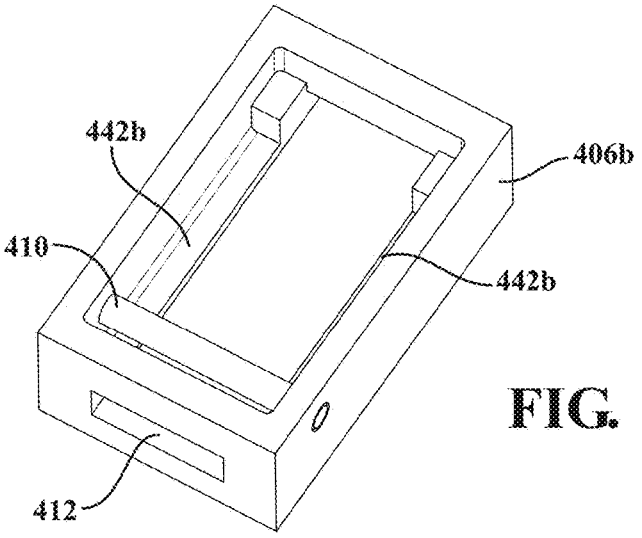
FIG. 14

ADJUSTABLE ELEMENT FOR ARTICLE OF FOOTWEAR

CROSS REFERENCE TO RELATED APPLICATIONS

This application claims priority under 35 U.S.C. § 119(e) to U.S. Provisional Application No. 63/414,973, filed on Oct. 11, 2022. The disclosure of this prior application is considered part of the disclosure of this application and is hereby incorporated by reference in its entirety.

FIELD

The present disclosure relates generally to an article of footwear, and more particularly to an adjustable element for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhancing traction with the ground surface.

DRAWINGS

The drawings described herein are for illustrative purposes only of selected configurations and not all possible implementations, and are not intended to limit the scope of the present disclosure.

FIG. 12 is a perspective view of a locking assembly of FIG. 11, where a locking element is in a first configuration;

FIG. 13 is a bottom perspective view of the locking element of FIG. 12, with a biasing member having first and second arms integrally formed with the locking element;

FIG. 14 is a top perspective view of a housing of the locking assembly of FIG. 11, where the housing has ledges to receive the first and second arms of the biasing member of FIG. 13;

Corresponding reference numerals indicate corresponding parts throughout the drawings.

DETAILED DESCRIPTION

Figure 1A:
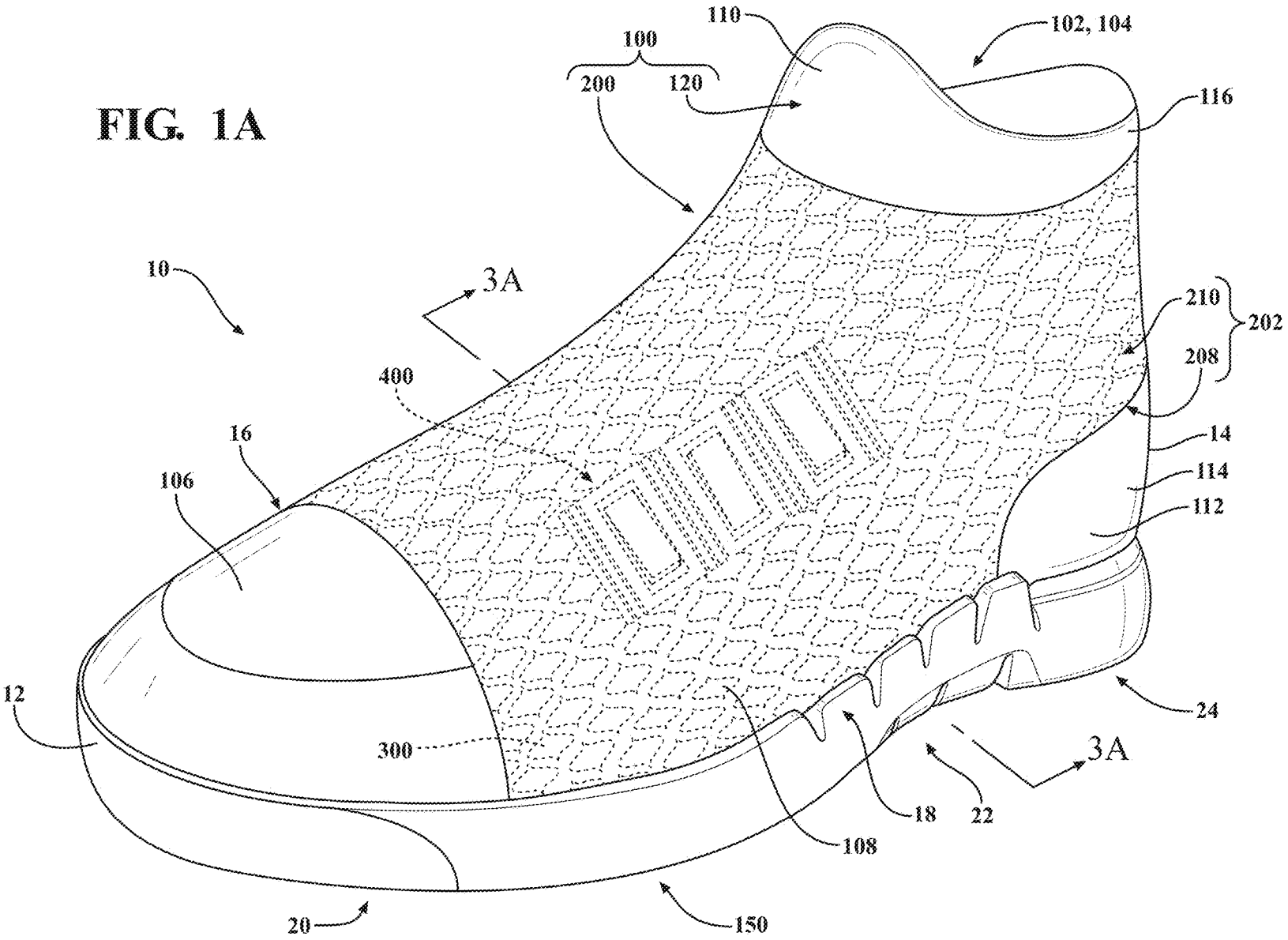
FIG. 1A is a front perspective view of an example of an article of footwear according to the present disclosure, where the article of footwear is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an adjustable element for an article of footwear includes a bladder having an interior void, a compressible component disposed within the interior void and operable between an expanded state and a contracted state, a lock strip including a first end anchored at a first location within the bladder and a second end disposed at an opposite end of the lock strip than the first end, and a lock receiving the lock strip and operable between a locked state restricting movement of the lock strip relative to the bladder and an unlocked state permitting movement of the lock strip relative to the bladder.

The adjustable element may include one or more of the following optional features. For example, the compressible component may include a passageway extending therethrough, the lock strip slidably received by the passageway. In one configuration, the compressible component may be formed from foam. Optionally, the lock strip may include a longitudinal axis extending between the first end and the second end. The compressible component may move along the longitudinal axis when moving between the expanded state and the contracted state. Additionally or alternatively, the lock strip may include a first side and a second side formed on an opposite side of the lock strip than the first side. The first side may include a first series of engagement features operable to engage the lock in the locked state. The lock may include a second series of engagement features operable to engage the first series of engagement features in the locked state and/or the lock may be biased into the locked state by a biasing member.

In one configuration, the compressible component may be moved from the expanded state to the contracted state by removing fluid from the interior void. The lock may be fixed relative to the bladder at a second location that is spaced apart from the first location. Optionally, an effective length of the lock strip may be reduced between the first location and the second location when the compressible component is moved from the expanded state to the contracted state. An article of footwear may incorporate the adjustable element.

In another configuration, an adjustable element for an article of footwear includes a bladder having an interior void, a compressible component disposed within the interior void and operable between an expanded state and a contracted state, a lock strip including a first end anchored at a first location within the bladder and a second end disposed at an opposite end of the lock strip than the first end, and a lock fixed relative to the bladder at a second location spaced apart from the first location and receiving the lock strip, the lock is operable to selectively fix a position of the lock strip relative to the bladder in a locked state when the compressible component is moved into the contracted state.

Optionally, the compressible component may include a passageway extending therethrough. In this configuration, the lock strip may be slidably received by the passageway. The compressible component may be formed from foam. In one configuration, the lock strip may include a longitudinal axis extending between the first end and the second end, the compressible component may move along the longitudinal axis when moving between the expanded state and the contracted state. Optionally, the lock strip may include a first side and a second side formed on an opposite side of the lock strip than the first side, the first side may include a first series of engagement features operable to engage the lock in the locked state. The lock may include a second series of engagement features operable to engage the first series of engagement features in the locked state and/or the lock may be biased into the locked state by a biasing member. In another implementation, the lock may be rotatable relative to the bladder. The compressible component may be moved from the expanded state to the contracted state by removing fluid from the interior void. Optionally, an effective length of the lock strip may be reduced between the first location and the second location when the compressible component is moved from the expanded state to the contracted state. An article of footwear may incorporate the adjustable element.

The details of one or more implementations of the disclosure are set forth in the accompanying drawings and the description below. Other aspects, features, and advantages will be apparent from the description, the drawings, and the claims.

Figure 1B:
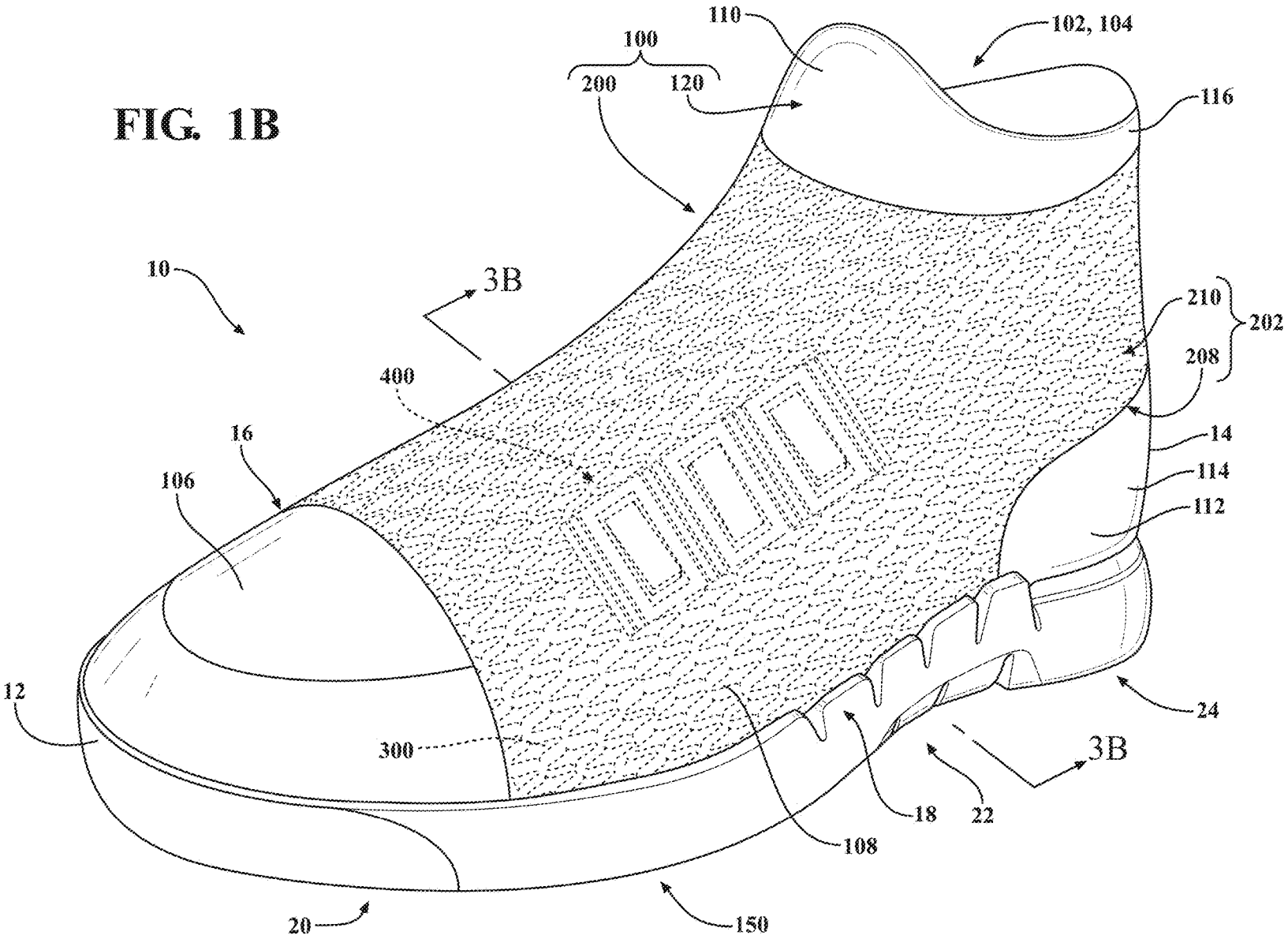
FIG. 1B is a front perspective view of the article of footwear of FIG. 1A, where the article of footwear is in a contracted state.

Referring to FIGS. 1A and 1, an article of footwear 10 includes an upper 100 and a sole structure 150. The footwear 10 may further include an anterior end 12 associated with a forward-most point of the footwear 10, and a posterior end 14 corresponding to a rearward-most point of the footwear 10. A medial side 16 and a lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 is associated with phalanges and metatarsal bones of a foot. The mid-foot region 22 may correspond with an arch area of the foot, and the heel region 24 may correspond with rear portions of the foot, including a calcaneus bone.

The upper 100 includes interior surfaces that define an interior space 102 and an ankle opening 104 configured to receive and secure a foot for support on the sole structure 150. The upper 100, and components thereof, may be described as including various subcomponents or regions. For example, the upper 100 includes a toe cap 106 disposed at the anterior end 12 and extending over the toes from the medial side 16 to the lateral side 18. A pair of quarter panels 108 extend from the toe cap 106 in the mid-foot region 22 on opposite sides of the interior space 102. A throat 110 extends across the top of the upper 100 and defines an instep region extending between the quarter panels 108 from the toe cap 106 to the ankle opening 104. In the illustrated example, the throat 110 is enclosed, whereby a material panel extends between the opposing quarter panels 108 in the instep region to cover the interior space 102. Here, the material panel covering the throat 110 may optionally be formed of a material having a higher modulus of elasticity than the material forming the quarter panels 108.

The upper 100 of the article of footwear 10 may be further described as including heel side panels 112 extending through the heel region 24 along the medial and lateral sides 16, 18 of the ankle opening 104. A heel counter 114 may be included and wraps around the posterior end 14 of the footwear 10 and connects the heel side panels 112. Uppermost edges of the throat 110, the heel side panels 112, and the heel counter 114 cooperate to form a collar 116, which defines the ankle opening 104 of the interior space 102.

The upper 100 may include an inner bootie 120 defining the interior space 102. The inner bootie 120 may be formed from one or more materials that are stitched or adhesively bonded together to form the interior space 102. Suitable materials of the upper 100 may include, but are not limited to, mesh textiles, foam, leather, and synthetic leather. The materials may be selected and located to impart properties of durability, air-permeability, wear-resistance, flexibility, and comfort. The example bootie 120 may be formed as an inner liner including a combination of one or more substantially inelastic or non-stretchable materials and/or one or more substantially elastic or stretchable materials disposed in different regions of the bootie 120 to facilitate movement of the article of footwear 10 between a tightened state and a loosened state. The one or more elastic materials may include any combination of one or more elastic fabrics such as, without limitation, spandex, elastane, rubber, or neoprene. The one or more inelastic materials may include any combination of one or more thermoplastic polyurethanes, nylon, leather, vinyl, or another material/fabric that does not impart properties of elasticity.

With reference to FIGS. 1A-3B, the upper 100 further includes an integrated adjustable element 200 attached to the bootie 120, such that the adjustable element 200 may define a portion of the upper 100 of the article of footwear 10. The adjustable element 200 includes a bladder 202 forming an interior void 204 and having a compressible component 300 disposed therein. A port 132 is connected to the bladder 202 and is in fluid communication between the interior void 204 and a pressure source 130, as described in more detail below. It is generally contemplated that the pressure source 130 may be a vacuum pump integrated with the footwear 10. For example, the pressure source 130 may be integrated in the heal region 24 of the article of footwear 10. Alternatively, the pressure source 130 may be a peripheral component provided separate from the footwear 10, such that the pressure source 130 may be attached and detached from the port 132. The pressure source 130 may include a vacuum line 134 through which a partial vacuum may be drawn or released to define a desired pressure within the interior void 204. The vacuum line 134 may be integrated within the medial and/or lateral sides 16, 18 of the article of footwear 10 (e.g., within the quarter panels 108) or may be positioned exterior to the upper 100 along the medial and/or lateral side 16, 18. It is also contemplated that the pressure source 130 may include multiple vacuum lines 134 to connect various portions of the adjustable element 200 with the pressure source 130 to maximize the efficiency of the pressure source 130. The pressure source 130 may be automatically actuated by a wearer of the footwear 10 during striking of a foot of the wearer. For example, as the wearer runs, walks, or generally moves about in the footwear 10, the pressure source 130 is actuated to draw an at least partial vacuum within the interior void 204 of the bladder 202. The pressure source 130 may have a minimum vacuum pressure threshold, such that once that minimum threshold is satisfied the pressure source 130 may stop drawing a vacuum. The vacuum may be retained within the interior void 204 until the wearer desires otherwise. Once the wearer desires to release the vacuum, the wearer may actuate a pressure release feature 136. The pressure release feature 136 may be a button or other compressible feature that the wearer may press to return the interior void 204 to the original internal pressure.

Figure 2A:
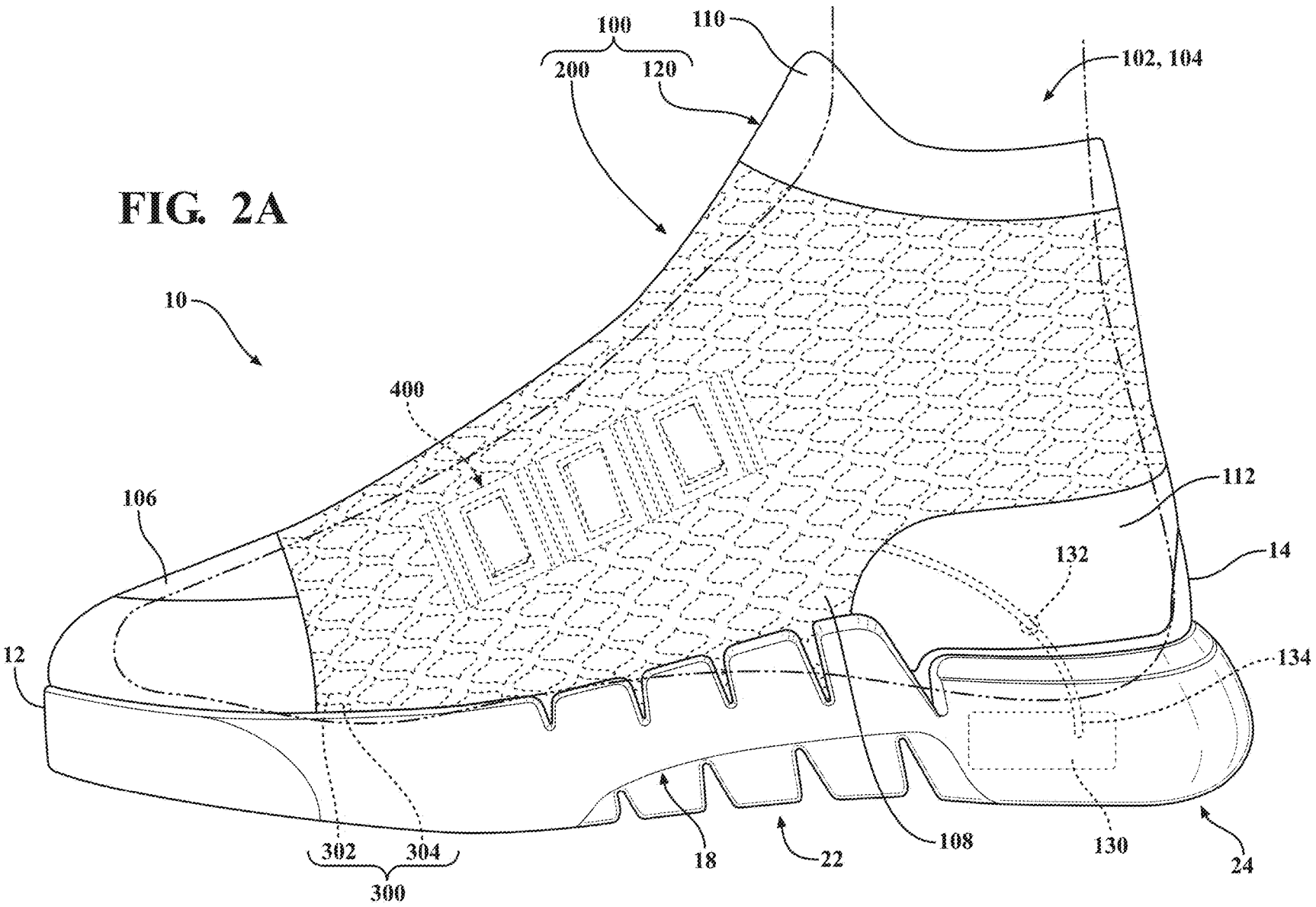
FIG. 2A is a lateral side view of the article of footwear of FIG. 1A, where the article of footwear is in the relaxed state.
Figure 2B:
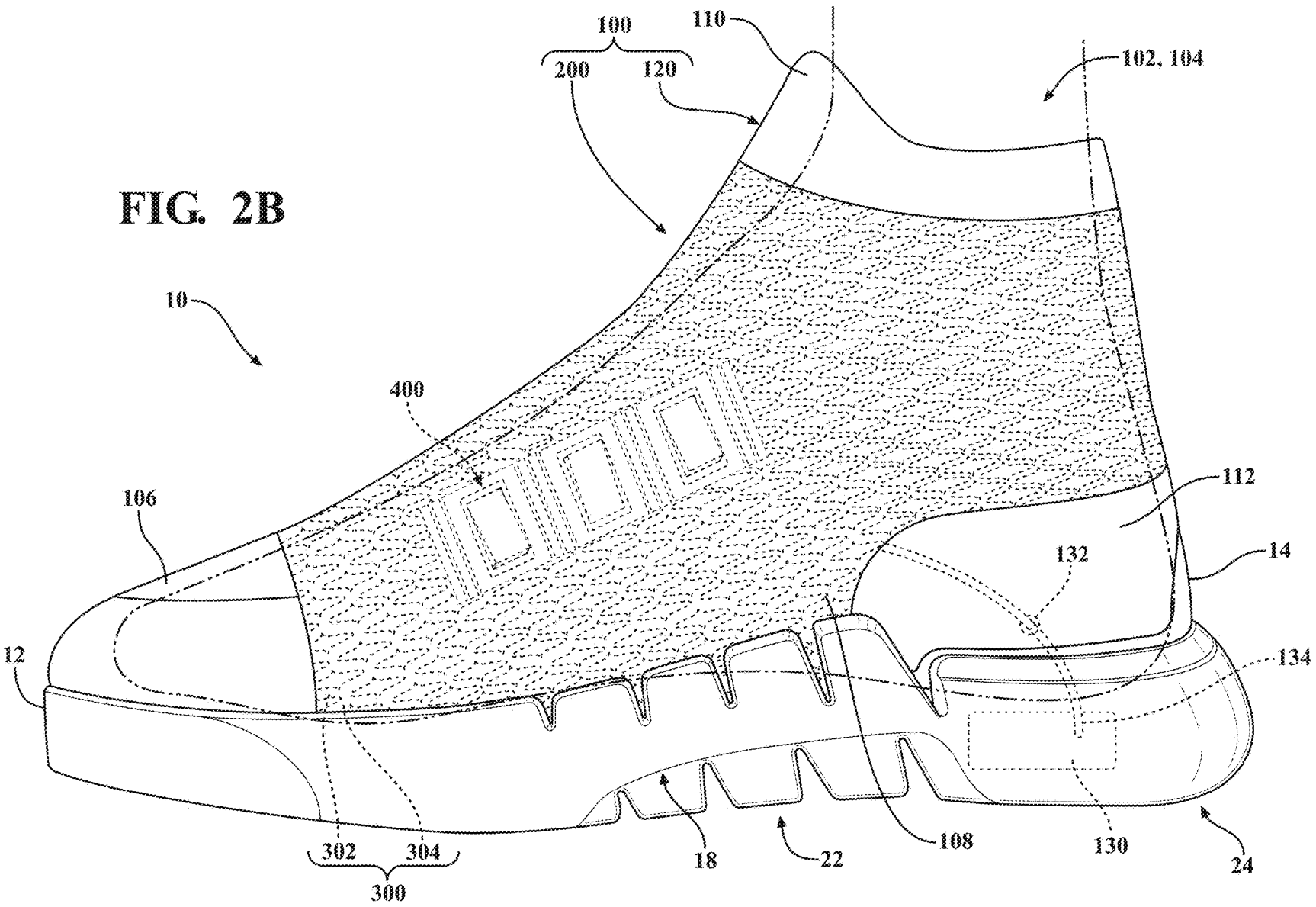
FIG. 2B is a lateral side view of the article of footwear in FIG. 1B, where the article of footwear is in the contracted state.

As discussed in greater detail below, the adjustable element 200 is fluidly coupled to the pressure source 130 and is operable to transition the compressible component 300 between a relaxed or expanded state (FIG. 2A) and a constricted or contracted state (FIG. 2B). For example, the compressible component 300 may be disposed within the interior void 204 and the expanded state may be defined by providing a first pressure, such as the original internal pressure prior to evacuation, within the interior void 204 and the contracted state may be defined by providing a second pressure, such as a pressure defined by the at least partial vacuum, within the interior void 204. It is generally contemplated that the first pressure of the interior void 204 may be greater than the second pressure. For example, the first pressure may be greater than or equal to an ambient pressure and the second pressure of the interior void 204 may be less than ambient pressure. Each of the first and second pressures may be dictated by the pressure source 130 to expand and contract the compressible component 300 and the adjustable element 200. The adjustable element 200 also includes a locking assembly 400, described below, which is integrated with the compressible component 300. The locking assembly 400 cooperates with the compressible component 300 to generally retain the adjustable element 200 in the contracted state (FIG. 2B) and is releasable to allow the adjustable element 200 to return to the relaxed state (FIG. 2A).

In the illustrated example, the adjustable element 200 includes a pair of side portions extending along the medial and lateral sides 16, 18 on opposite sides of the throat 110 from the toe cap 106 to the heel region 24. As generally shown in FIG. 1A, the side portions of the adjustable element 200 each terminate along the respective medial and lateral sides 16, 18 of the heel counter 114.

Figure 3A:
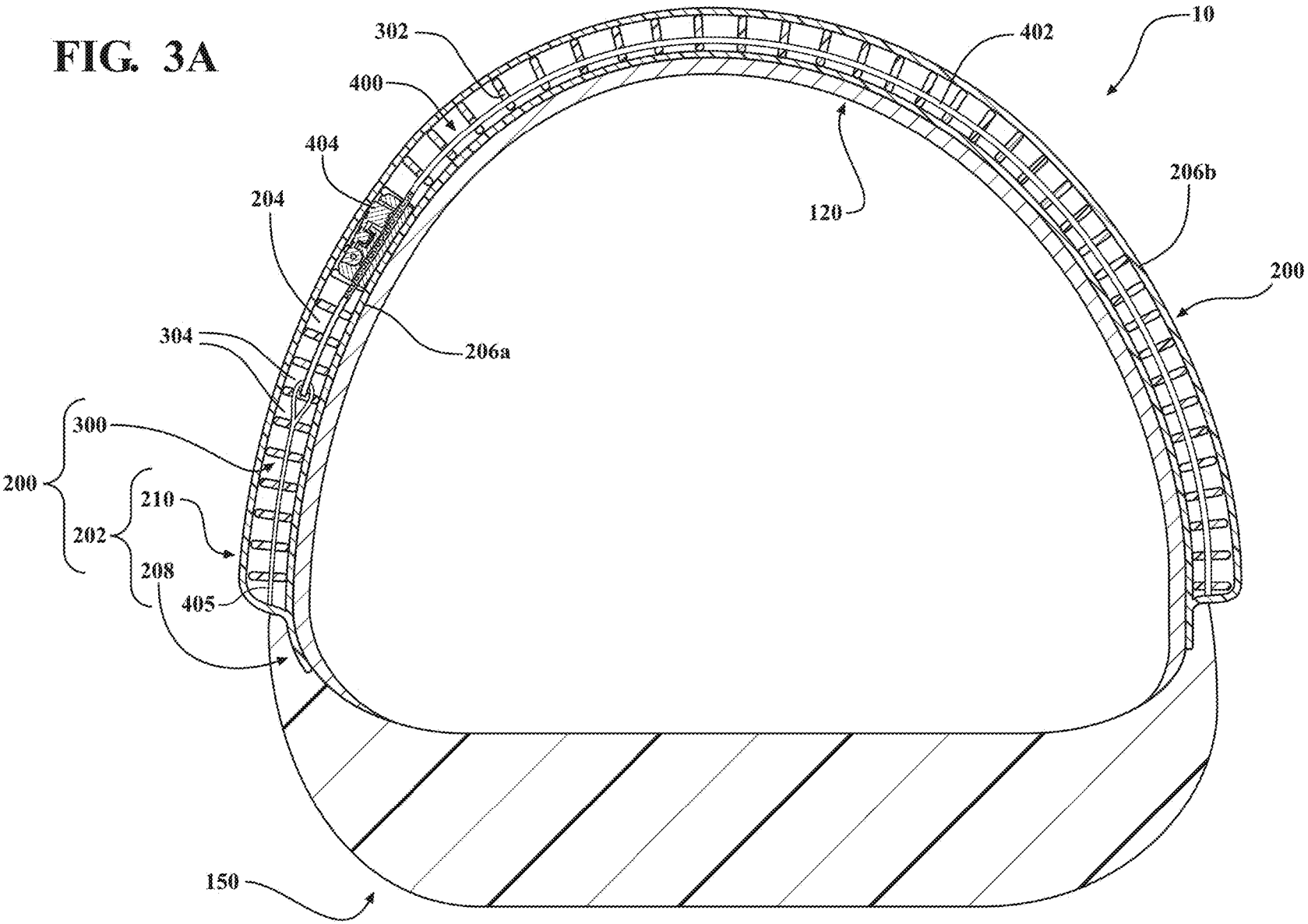
FIG. 3A is a cross-sectional view of the article of footwear of FIG. 1A, taken along Line 3A-3A in FIG. 1A.
Figure 3B:
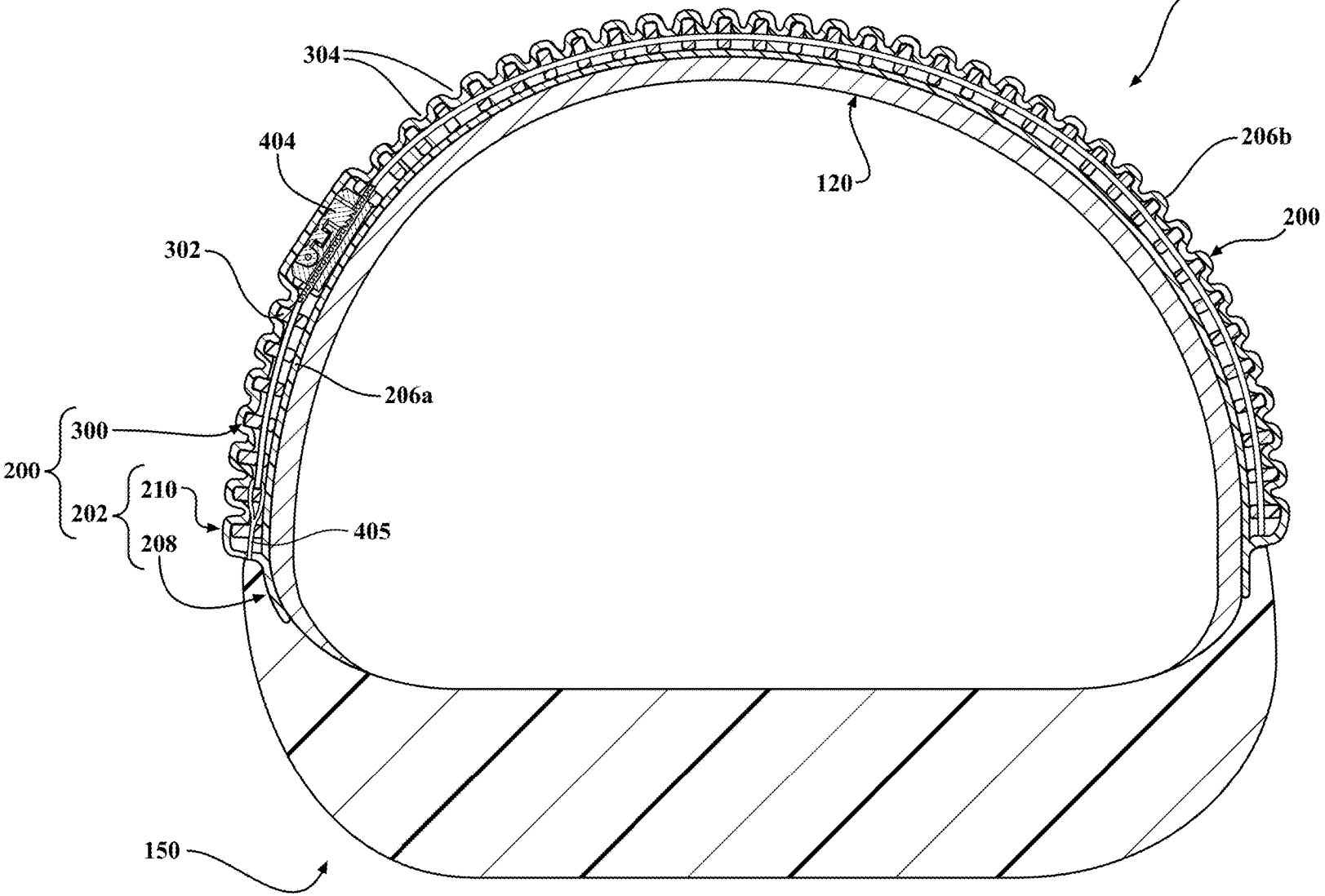
FIG. 3B is a cross-sectional view of the article of footwear of FIG. 1B, taken along Line 3B-3B in FIG. 1B.

With reference to FIGS. 3A and 3B, the adjustable element 200 is illustrated with the locking assembly 400 disposed within the bladder 202. As described in more detail below, the locking assembly 400 includes a locking strip 402 and a locking element 404. The locking strip 402 is coupled to the bladder 202 via an elastic tether 405 that is configured to expand and contract when the adjustable element 200 translates between a relaxed state (FIG. 3A) and a constricted state (FIG. 3B). For example, when the upper 100 is in the constricted state, the elastic tether 405 contracts and draws the locking strip 402 through the locking element 404 to at least partially retain the constricted state of the upper 100. The adjustable element 200 includes an inner barrier layer 206*a* attached to an exterior surface of the bootie 120, and an outer barrier layer 206*b* defining at least a portion of an exterior surface of the upper 100. Interior surfaces of the barrier layers 206*a*, 206*b* face each other and are joined to each other at discrete locations to form a peripheral seam 208 that surrounds the interior void 204 to define a chamber 210 of the bladder 202.

As used herein, the term "barrier layer" (e.g., barrier layers 206*a*, 206*b*) encompasses both monolayer and multilayer films. In some embodiments, one or both of barrier layers the 206*a*, 206*b* are each produced (e.g., thermoformed or blow molded) from a monolayer film (a single layer). In other embodiments, one or both of the barrier layers 206*a*, 206*b* are each produced (e.g., thermoformed or blow molded) from a multilayer film (multiple sublayers). In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 206*a*, 206*b* can independently be transparent, translucent, and/or opaque. As used herein, the term "transparent" for a barrier layer and/or a chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 206*a*, 206*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 206*a*, 206*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 206*a*, 206*b* include two or more sublayers, examples of suitable multilayer films include microlayer films, such as those disclosed in Bonk et al., U.S. Pat. No. 6,582,786, which is incorporated by reference in its entirety. In further embodiments, barrier layers 206*a*, 206*b* may each independently include alternating sublayers of one or more TPU copolymer materials and one or more EVOH copolymer materials, where the total number of sublayers in each of the barrier layers 206*a*, 206*b* includes at least four (4) sublayers, at least ten (10) sublayers, at least twenty (20) sublayers, at least forty (40) sublayers, and/or at least sixty (60) sublayers.

The chamber 210 can be produced from the barrier layers 206*a*, 206*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 206*a*, 206*b* can be produced by co-extrusion followed by vacuum thermoforming to produce an inflatable chamber 210, which can optionally include one or more valves (e.g., one way valves) that allows the chamber 210 to be filled with the fluid (e.g., gas).

The chamber 210 can be provided in a fluid-filled (e.g., as provided in footwear 10) or in an unfilled state. The chamber 210 can be filled to include any suitable fluid, such as a gas or liquid. In an aspect, the gas can include air, nitrogen ($N_2$), or any other suitable gas. The fluid provided to the chamber 210 can result in the chamber 210 being pressurized. Alternatively, the fluid provided to the chamber 210 can be at atmospheric pressure such that the chamber 210 is not pressurized but, rather, simply contains a volume of fluid at atmospheric pressure.

The chamber 210 desirably has a low gas transmission rate to preserve its retained gas pressure. In some embodiments, the chamber 210 has a gas transmission rate for nitrogen gas that is at least about ten (10) times lower than a nitrogen gas transmission rate for a butyl rubber layer of substantially the same dimensions. In an aspect, chamber 210 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 206*a*, 206*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the inner barrier layer 206*a* and the outer barrier layer 206*b* cooperate to define a geometry (e.g., thicknesses, width, and lengths) of the chamber 210. The peripheral seam 208 may extend around the chamber 210 to seal the fluid (e.g., air) within the chamber 210. Thus, the chamber 210 is associated with an area of the bladder 202 where interior surfaces of the upper and lower barrier layers 206*a*, 206*b* are not joined together and, thus, are separated from one another.

In some examples, the barrier layers 206*a*, 206*b* may include the same materials to provide the chamber 210 with a homogenous barrier construction, such that both sides of the adjustable element 200 will contract and relax at the same rate when pressure within the chamber 210 is adjusted. Alternatively, a first one of the barrier layers 206*a*, 206*b* may be at least partially constructed of a different barrier material and/or configuration than the other one of the barrier layers 206*a*, 206*b* to selectively impart a contour as the adjustable element 200 transitions between the relaxed state and the contracted state. For example, one of the barrier layers 206*a*, 206*b* may be at least partially formed with a different modulus of elasticity and/or stiffness than the other barrier layer 206*a*, 206*b*, such that when the adjustable element 200 transitions from the relaxed state to the contracted state, the first one of the barrier layers 206*a*, 206*b* contracts at a different rate than the other barrier layer 206*a*, 206*b* to cause the adjustable element 200 to curl.

Referring still to FIGS. 2A-3B, the transition between the relaxed state and the contracted state of the adjustable element 200 occurs when the pressure source 130 is activated to alter the interior pressure of the adjustable element 200. For example, the pressure source 130 may draw a vacuum within the chamber 210 of the bladder 202 to translate the compressible component 300 into the contracted state (FIG. 2B). It is generally contemplated that the compressible component 300 is operable between an expanded state (FIG. 2A) and a contracted state (FIG. 2B), which respectively correspond to the relaxed state (FIG. 3A) and contracted state (FIG. 3B) of the adjustable element 200. Described in more detail below, the adjustable element 200 includes one or more locking assemblies 400 disposed between the first and second barrier layers 206*a*, 206*b* within the bladder 202. The locking assembly 400 is coupled to or otherwise integrated with the compressible component 300 within the interior void 204 of the bladder 202 and is operable between an unlocked state and a locked state. As illustrated in FIG. 2A, the compressible component 300 includes a lattice structure 302 and may have a defined geometry that includes reliefs 304. Stated differently, the lattice structure 302 may include different geometrical configurations to impart different constriction profiles in different areas of the upper 100.

As illustrated in FIG. 2B and upon decreasing the pressure in the interior void 204, the lattice structure 302 collapses along the width-wise directions of the reliefs 304 and the upper 100 constricts around the foot, such that the compressible component 300 is in the contracted state. Conversely, the pressure within the interior void 204 is increased to allow the compressible component 300 to move into the expanded state, such that the adjustable element 200 and the upper 100 are in the relaxed state. Here, the resilient material and/or geometry of the lattice structure 302 of the compressible component 300 may bias the adjustable element 200 and the upper 100 towards the relaxed or expanded state. Similarly, the adjustable element 200 of FIG. 4 is a resilient structure that, upon increased pressure, returns to the relaxed state and can compress when the pressure within the interior void 204 (FIG. 3B) is decreased.

Figure 4:
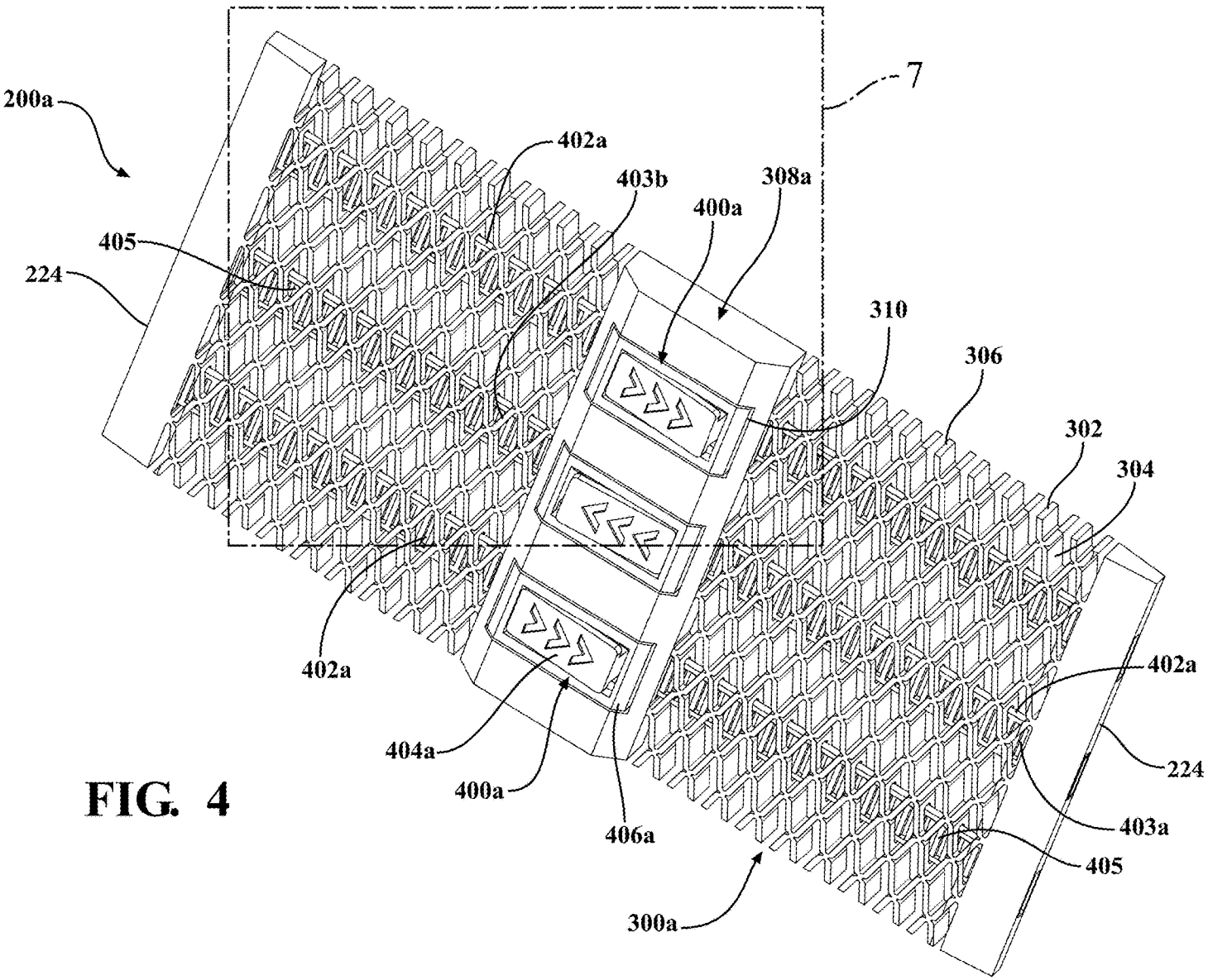
FIG. 4 is a perspective view of an example of an adjustable element according to the present disclosure, where a compressible component has a lattice structure.
Figure 5:
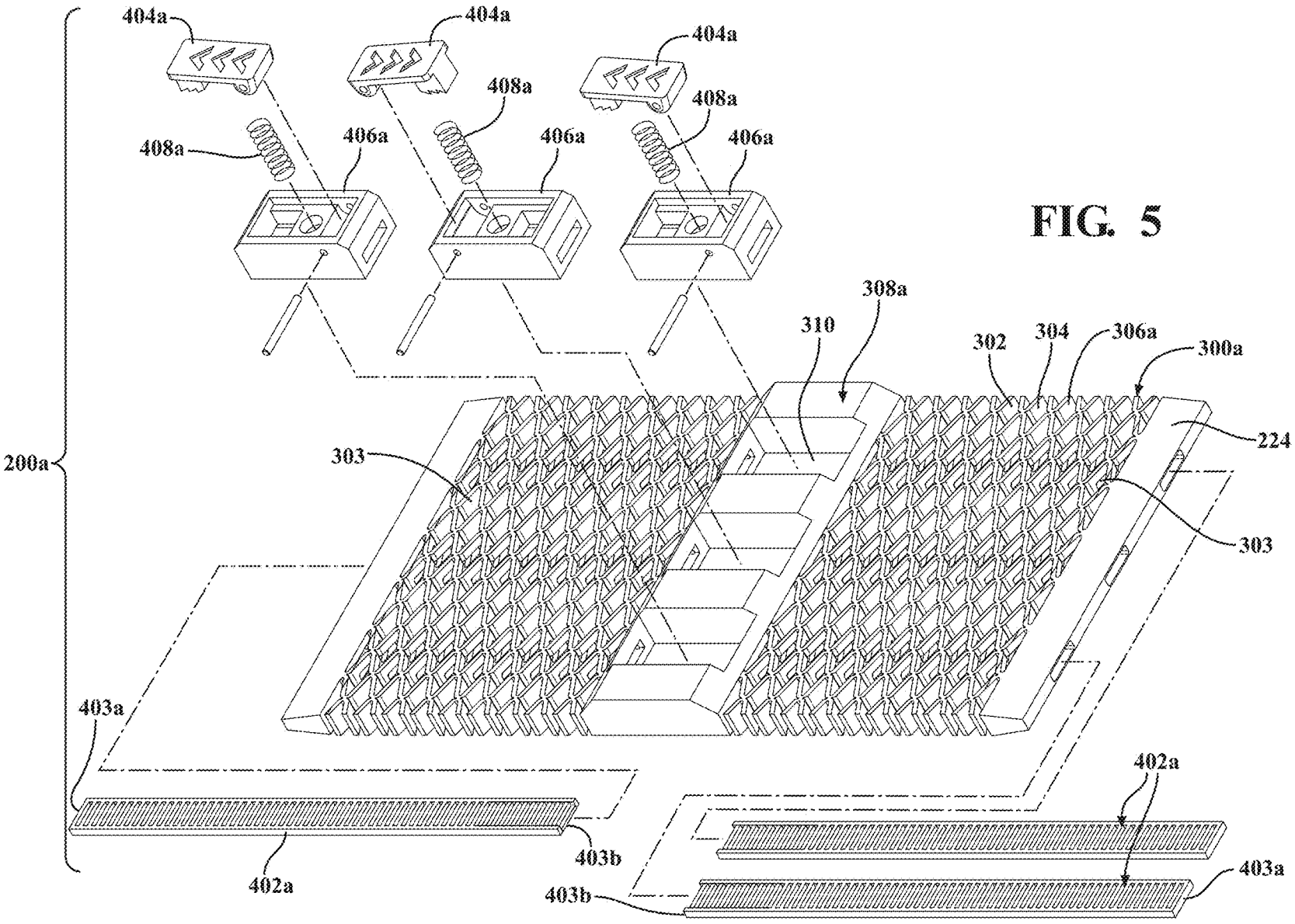
FIG. 5 is an exploded perspective view of the adjustable element of FIG. 4 with a locking assembly and the compressible component.

With reference now to FIGS. 4 and 5, a generic example of an adjustable element 200*a* according to the principles of the present disclosure is shown. One or more of the features adjustable element 200*a* may be incorporated into an article of footwear 10, such as shown in FIGS. 1-3B. The one or more locking assemblies 400 of the adjustable element 200*a* are associated with or attached to the compressible component 300. For example, the locking assemblies 400 may be attached to a side of the compressible component 300*a* or integrated within the compressible component 300*a*. It is also contemplated that the adjustable element 200*a* may be configured with a single locking assembly 400. The adjustable element 200*a* illustrated in FIG. 4 includes tapered ends 224 on either end of a compressible component 300*a*.

Figure 6:
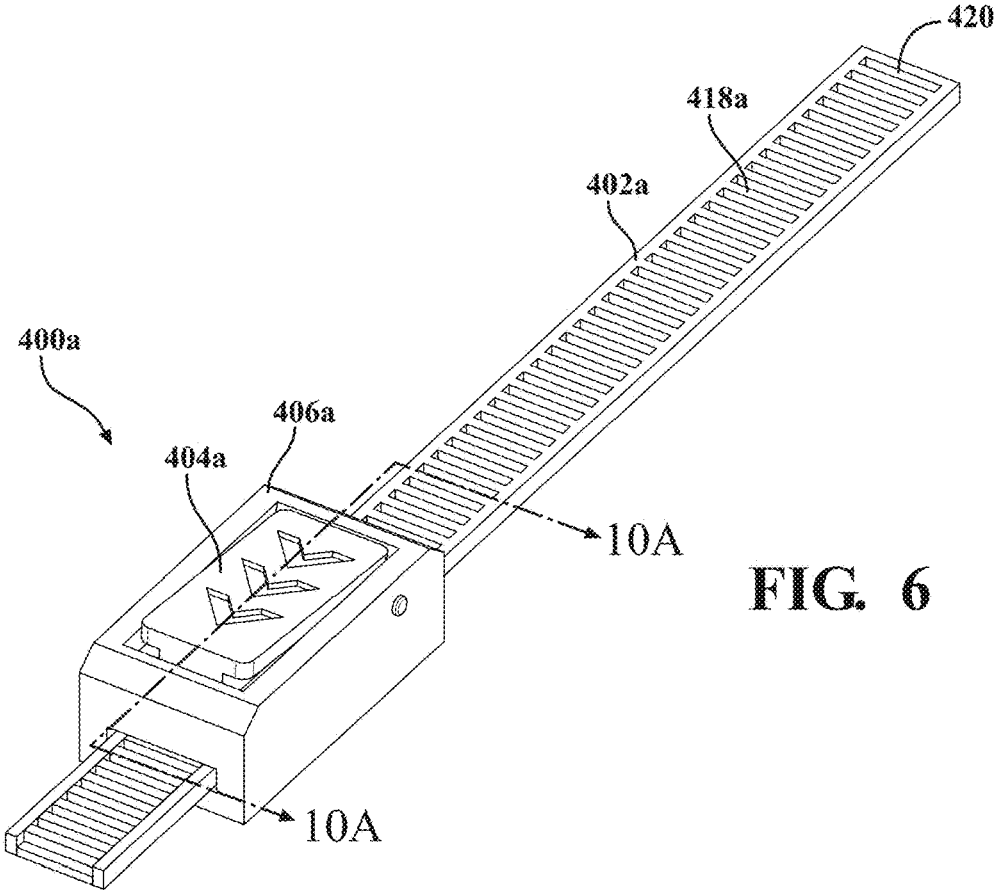
FIG. 6 is a top perspective view of the locking assembly of FIG. 5, where a locking element of the locking assembly is in a first configuration.

Referring to FIGS. 4-6, the compressible component 300*a* of the adjustable element 200*a* has one or more first portions or adjustment members 306*a* and a second portion or dock 308*a*. Each locking assembly 400*a* may be positioned within a respective receptacle 310 defined by the dock 308*a* of the compressible component 300*a* to fix a position of the locking assemblies 400*a* relative to one another and to the adjustable element 200*a*. The lattice structure 302 generally defines the adjustment members 306*a* of the compressible component 300*a*. It is further contemplated that the lattice structure 302 may define slits (e.g., passageways) 303 through which a locking strip 402*a* of each locking assembly 400*a* may pass, as described in greater detail below.

As illustrated in FIG. 4, the locking strips 402*a* may be staggered on opposing sides of the dock 308*b* of the compressible component 300*a*, whereby a first one of the locking strips 402*a* includes an anchored first end 403*a* attached to the first tapered end 224 and a free second end 403*b* interfacing with a first one of the locking assemblies 400*a* while an adjacent second one of the locking strips 402*a* includes an anchored first end attached to the opposite second tapered end 224 and a free second end interfacing with a second one of the locking assemblies 400*a*. Additionally or alternatively, the locking strips 402*a* may be disposed on the same side relative to the dock 308*b*. Each locking strip 402*a* may include a first end coupled to one of the tapered ends 224 of the adjustable element 200*a*, such that the locking strip 402*a* is disposed at the adjustment member 306*a* of the compressible component 300*a*. It is also contemplated that a second end of the locking strip 402*a* may be coupled to the opposing tapered end 224 via an elastic tether 405 to retain the second end of the locking strip 402*a* along a curvature of the upper 100 (FIG. 3A). Stated differently, the second end of the locking strip 402*a* that is inserted through the locking assembly is retained along the upper 100 (FIG. 3A) by the tether 405 to follow the general curvature thereat. It is contemplated that the elastic tether 405 is elongated in the relaxed state of the upper 100 and is compressed or otherwise shortened under the applied vacuum in the constricted state of the upper 100. The compressible component 300*a* may expand and contract about the locking assemblies 400*a*, such that the locking strip 402*a* of the locking assembly 400*a* is translated through the locking assembly 400*a*, at least in part, by the movement of the compressible component 300*a*. Although described with respect to FIGS. 4-6, it is contemplated that the configuration of the locking assembly 400*a* and its components relative to the compressible component 300*a* may be incorporated in additional or alternate configurations discussed herein.

Figure 7:
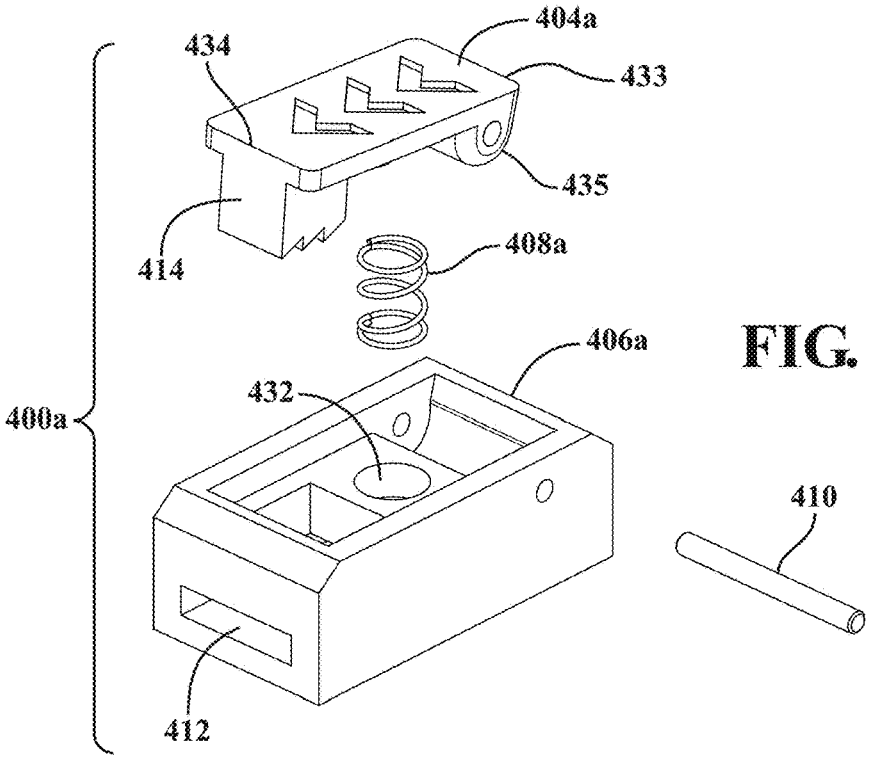
FIG. 7 is an exploded perspective view of the locking assembly of FIG. 6, where a biasing member of the locking assembly is positioned between the locking element and a housing of the locking assembly.

Referring to FIG. 7, the locking assembly 400*a* includes a locking element 404*a* disposed within a housing 406*a* and a biasing member 408*a*. The biasing member 408*a* may have an extended state that corresponds to the first configuration of the locking element 404*a* and a compressed state that corresponds to the second configuration of the locking element 404*a*. The locking element 404*a* is attached to the housing 406*a* via a dowel 410, and the housing 406*a* defines a slot 412 through which the locking strip 402*a* is received and extends. It is contemplated that the locking element 404*a* is disposed at the dock 308*a* of the compressible component 300*a* and is operable between a first configuration and a second configuration. The first configuration of the locking element 404*a* generally corresponds to the expanded state of the compressible component 300*a* and/or the relaxed state of the adjustable element 200*a*, and the second configuration of the locking element 404*a* generally corresponds to the contracted state of the compressible component 300*a* and/or the adjustable element 200*a*. The locking element 404 has engagement features 414 that extend from a body 416 of the locking element 404*a* and engage with an interface surface 418*a* of the locking strip 402*a* when the locking element 404*a* is in the second configuration.

Figure 8:
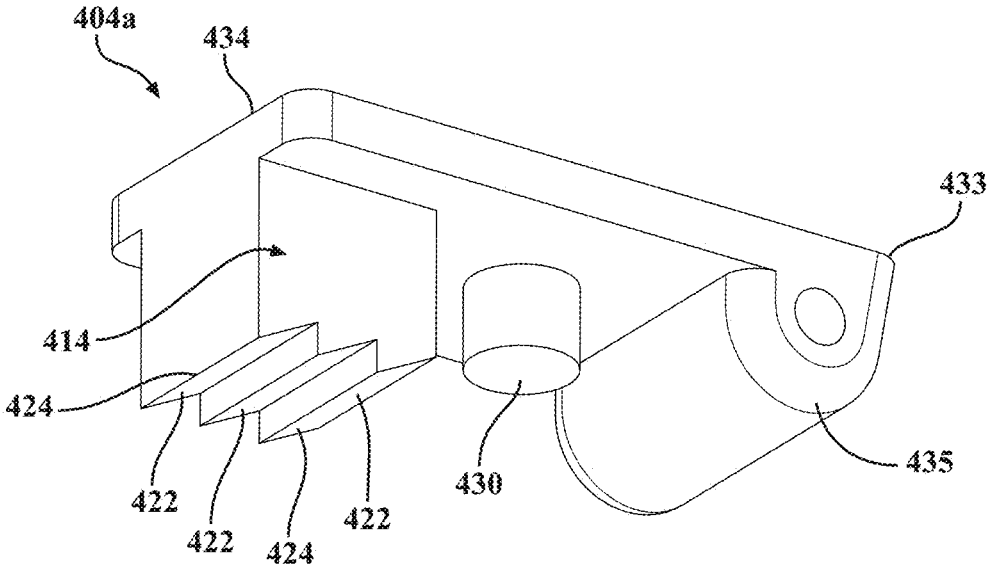
FIG. 8 is a bottom perspective view of the locking element of FIG. 7, where the locking element includes engagement features that each have a biasing surface.

The engagement features 414 of the locking element 404*a* each have a biasing surface 422 formed at an oblique angle, such that the engagement features 414 are angled to engage the interface surface 418*a* of the locking strip 402*a*. It is contemplated that the engagement features 414 may generally define a plurality of teeth 414 having a stepped configuration with the angled biasing surfaces 422 in part defining an engagement edge 424 of each engagement feature 414. While the biasing surfaces 422 facilitate movement of the locking strip 402*a* in a first direction D1 relative the locking element 404*a*, the engagement edges 424 are configured to abut or otherwise engage with the interface surface 418*a* to prevent movement of the locking strip 402*a* in an opposite second direction relative to the locking element 404*a*. As illustrated in FIG. 8, the biasing member 408*a* is disposed between the locking element 404*a* and the locking strip 402*a* and has a compressed state that corresponds to the contracted state of the compressible component 300*a*, as described below.

Referring now to FIGS. 5-10B, operation of the locking assembly 400*a* will be described in detail. The locking assembly 400*a* includes the locking element 404*a* attached to and disposed within the housing 406*a* with the locking strip 402*a* at least partially disposed within the housing 406*a*. The locking strip 402*a* has the interface surface 418*a* that defines a plurality of detents or spaces 420 in which the engagement features 414 of the locking element 404*a* may be selectively disposed. For example, the locking element 404*a* may translate from the first configuration to the second configuration, such that the engagement features 414*a* are engaged with the plurality of spaces 420 defined along the interface surface 418*a*. Translation of the locking element 404*a* from the first configuration (FIG. 10A) to the second configuration (FIG. 10B) occurs when the compressible component 300*a* is moved from the expanded state to the contracted state. Namely, when the pressure source 130 (FIG. 2B) alters the pressure within the interior void 204 (FIG. 3B) of the bladder 202 (FIG. 3B), the locking element 404*a* engages the interface surface 418*a* of the locking strip 402*a* due to the pressure exerted on the locking element 404*a* by one of the barrier layers 206*a*, 206*b* when the bladder 202 is placed under vacuum. The engagement features 414 lock or otherwise retain the locking strip 402*a* relative to the housing 406*a*, such that the locking strip 402*a* is prevented from additional lateral movement in at least one direction. For example, the locking strip 402*a* may translate in a first direction D1 toward the housing 406*a* as the compressible component 300*a* moves further into the compressed state, and the locking strip 402*a* is prevented from translating in an opposite second direction D2 away from the housing 406*a* by the engagement features 414 of the locking element 404*a*.

The locking strip 402*a* remains in a locked state via the engagement features 414 for the duration of the compressible component 300 and/or the adjustable element 200*a* being in the contracted state. While the locking strip 402*a* may be prevented from moving in an opposite second direction away from the housing 406*a*, it is contemplated that the locking strip 402*a* may be further extended toward the housing 406*a* even while the engagement features 414 are engaged with the interface surface 418*a*. For example, the pressure source 130 (FIG. 2B) may further decrease the pressure within the interior void 204 (FIG. 3B), which may further compress the compressible component 300 and draw the locking strip 402*a* toward the housing 406*a*. In this further evacuated configuration, the locking strip 402*a* may pass along the biasing surface 422 of the engagement feature 414 and be locked in place by the engagement edge 424 of the engagement features 414. Stated differently, the engagement features 414 engage the interface surface 418*a* when the locking element 404*a* is in the second configuration (FIG. 10B) as a result of a vacuum being applied within the interior void 204 (FIG. 3B) of the bladder 202 (FIG. 3B). The locking element 404*a* is biased to the first configuration by a biasing member 408*a* when the vacuum pressure is removed, such that the interior void 204 (FIG. 3A) has a first pressure corresponding to the expanded state of the compressible component 300*a*, as described in greater detail below.

Figure 9:
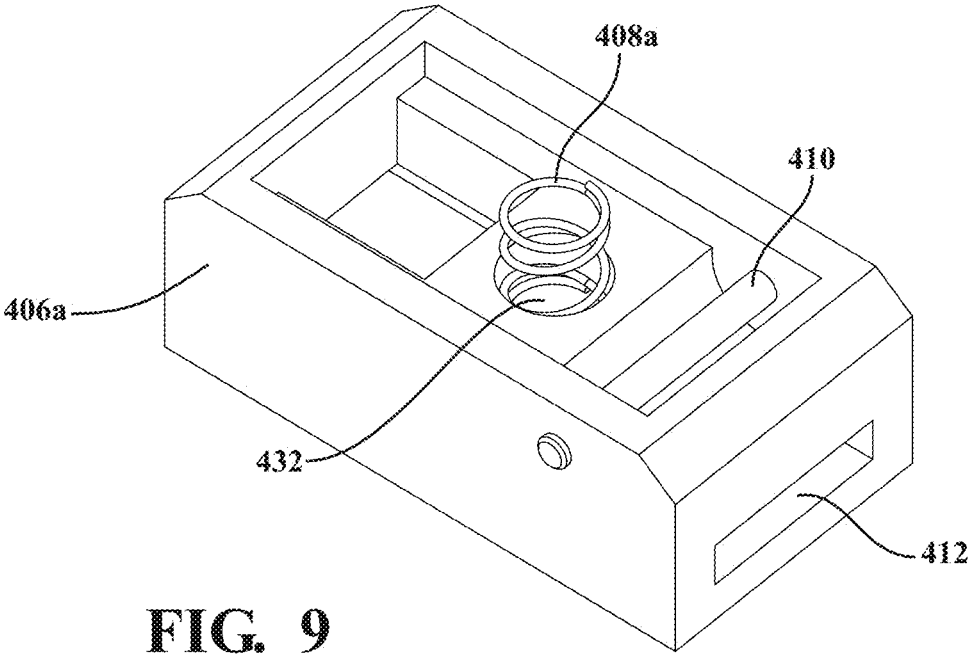
FIG. 9 is a top perspective view of the housing and the biasing member of FIG. 7.

As illustrated in FIGS. 8-9, the locking element 404*a* includes a projection 430 that extends into an opening 432 defined by the housing 406*a*. The biasing member 408*a* is disposed within the opening 432 around the projection 430 of the locking element 404*a*. The biasing member 408*a* is depicted as a helical spring (FIG. 7). It is also contemplated that the biasing member 408*a* may have alternate configurations including, but not limited to, a leaf spring and/or a living hinge. As the biasing member 408*a* translates the locking element 404*a* from the second configuration back to the first configuration, the locking element 404*a* rotates about the dowel 410 within the housing 406*a*. As shown in FIG. 8, the locking element 404*a* includes a first end 433 and an opposite second end 433. The first end 433 includes a hinge element 435 configured to receive the dowel 410. The second end 434 of the locking element 404*a* may be raised or be otherwise at least partially disposed above the housing 406*a*. The second end 434 of the locking element 404*a* may be depressed into the housing 406*a* when the pressure within the interior void 204 (FIG. 3B) of the bladder 202 (FIG. 3B) is decreased by the pressure source 130 (FIG. 2B).

Figure 10A:
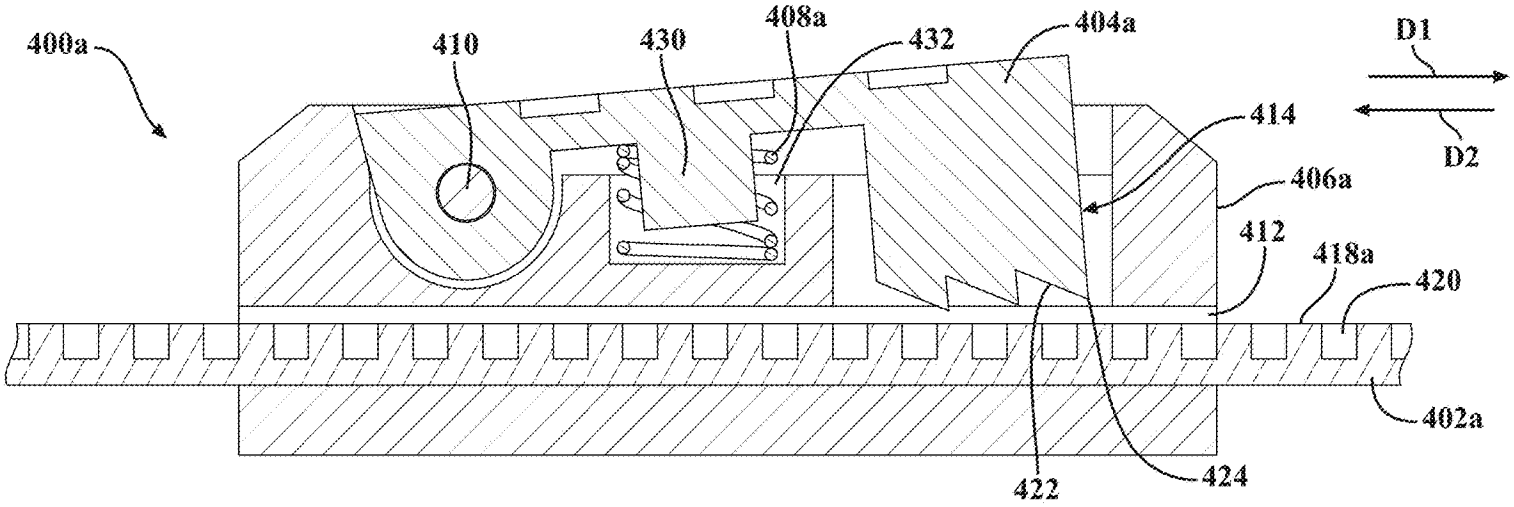
FIG. 10A is a cross-sectional view of the locking assembly of FIG. 6, taken along Line 10A-10A in FIG. 6, where the locking element is in the first configuration.
Figure 10B:
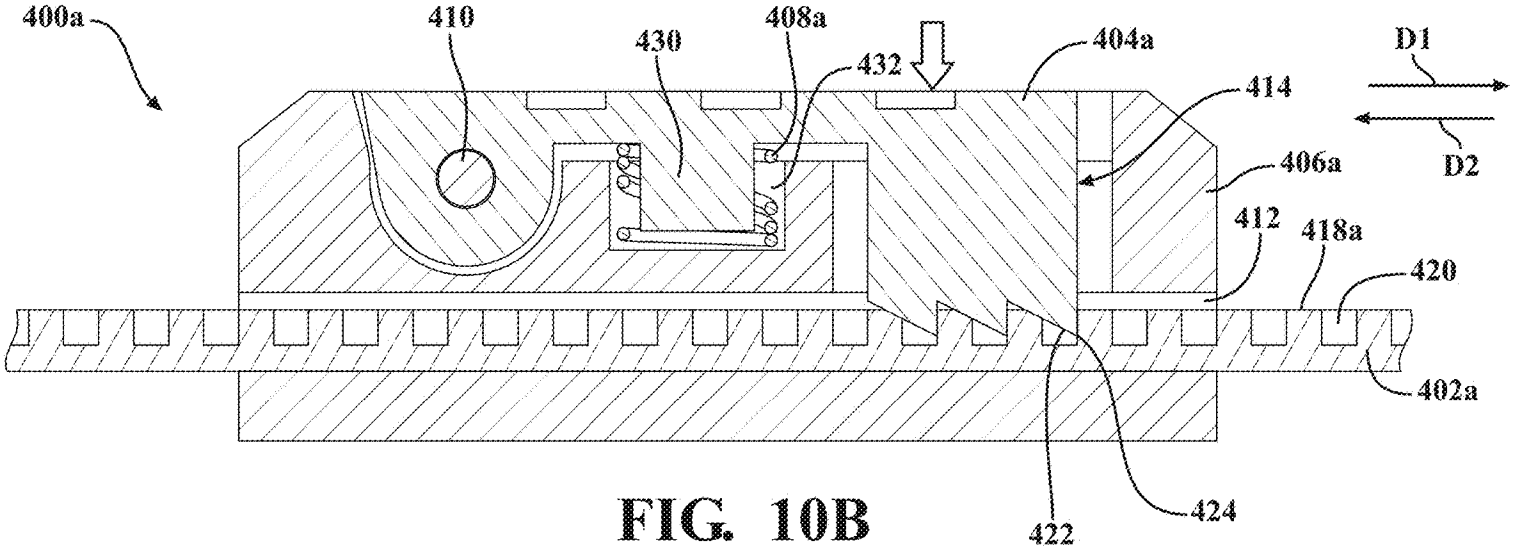
FIG. 10B is a cross-sectional view of the locking assembly of FIG. 10A, where the locking element is in a second configuration.
Figure 11:
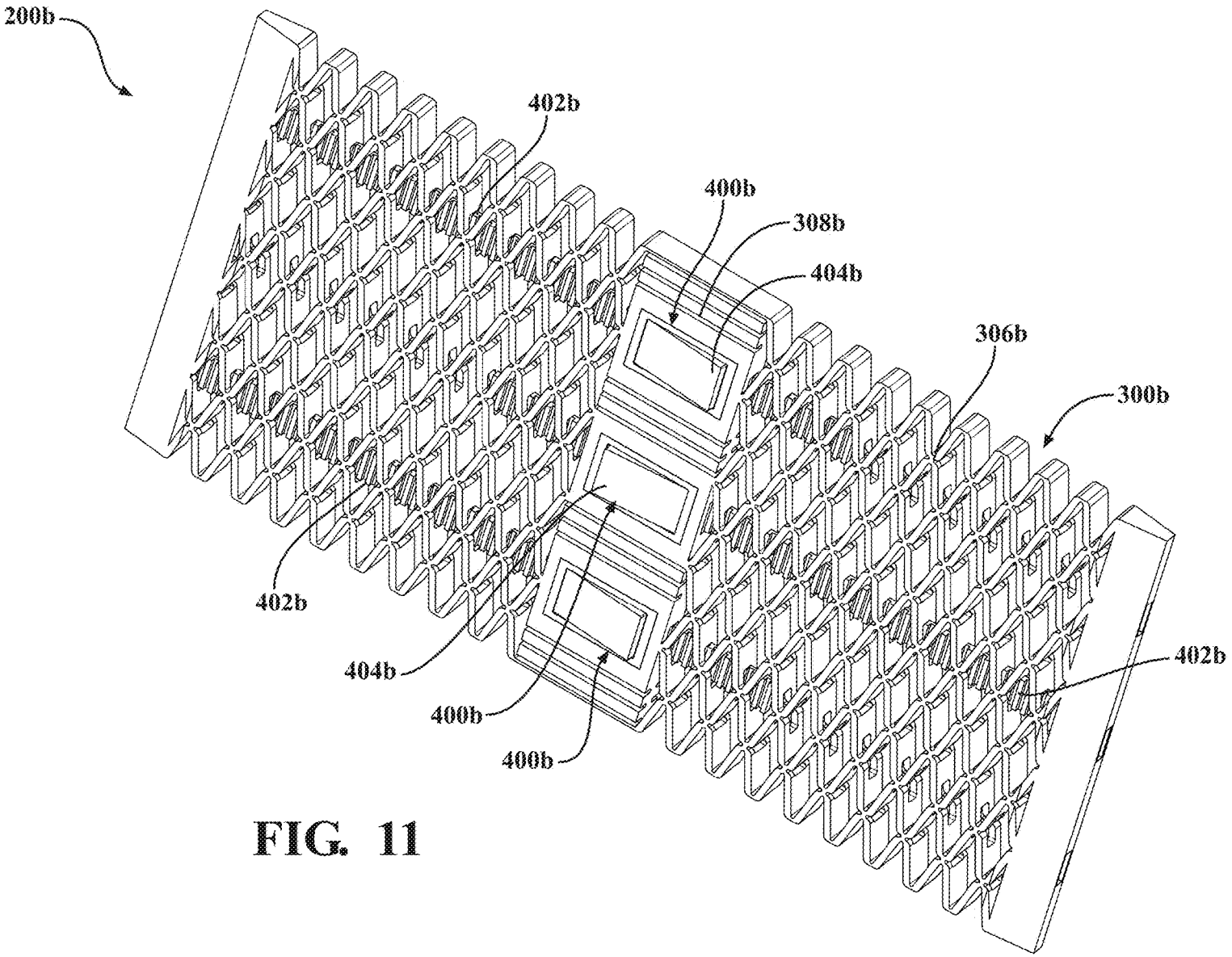
FIG. 11 is another example of an adjustable element according to the present disclosure.

Referring to FIGS. 10A and 10B, the locking element 404*a* is depicted in the first configuration (FIG. 10A) and the second configuration (FIG. 10B). The second end 434 of the locking element 404*a* is raised relative the housing 406*a* when the locking element 404*a* is in the first configuration, such that the locking strip 402*a* may move freely within the housing 406*a*. When the locking element 404*a* is in the second configuration (FIG. 10B), the locking strip 402*a* may move along the angled surface 422 of the engagement features 414 as the compressible component 300*a* enters the contracted state. As mentioned above, in the second configuration of the locking element 404*a*, the locking strip 402*a* is prevented from translating in an opposite second direction by the engagement edge 424 of the engagement features 414 abutting the interface surface 418*a* of the locking strip 402*a*. For example, the engagement edges 424 are disposed within the spaces 420 defined by the interface surface 418*a* of the locking strip 402*a* (FIG. 10B) as the locking element 404*a* is compressed or otherwise translated within the housing 406*a* toward the locking strip 402*a*. When the adjustable element 200 is under vacuum, the second end 434 of the locking element 404*a* has a greater moment of force applied to compress the biasing member 408*a* and generally lock the locking strip 402*a* via the engagement features 414. For example, the moment of force is depicted in FIG. 10B as an arrow applied downward on the second end 434 of the locking element 404*a*.

With particular reference to FIGS. 11-14, another example of an adjustable element 200*b* incorporating the principles of the present disclosure is provided. In view of the substantial similarity in structure and function of the components associated with the adjustable element 200*b* with respect to the adjustable element 200*a*, like reference numerals are used hereinafter and in the drawings to identify like components while like reference numerals containing letter extensions are used to identify those components that have been modified.

With reference now to FIGS. 11-14, an adjustment element 200*b* is illustrated with a locking assembly 400*b* integrated within a dock 308*b* of a compressible component 300*b*. In this example, the dock 308*b* is generally flush relative the lattice structure 302 of the compressible component 300*b*. The locking assembly 400*b* is depicted with a locking strip 402*b* disposed within a first portion 306*b* of the compressible component 300*b* and a locking element 404*b* received within a housing 406*b*. The locking element 404*b* includes a biasing member 408*b* that is integrally formed with the locking element 404*b*, as described below. The locking strip 402*b* is illustrated as having a plurality of teeth 440 that define an interface surface 418*b* of the locking strip 402*b*. As described below, the engagement features 414 of the locking element 404*b* engage the teeth 440*b* along the interface surface 418*b* to generally restrain the locking strip 402*b* from moving in at least one direction.

The engagement features 414 are positioned on the locking element 404*b* at an opposing end (i.e., a second end 434*b*) from the biasing member 408*b*. The housing 406*b* may define a pair of ledges 442*b* (FIG. 14) with which the biasing member 408*b* engages. As mentioned above, the locking element 404*b* is attached to the housing 406*b* via the dowel 410 and rotates about the dowel 410 relative to and within the housing 406*b*. In this example, the biasing member 408*b* includes a first arm 444*b* and a second arm 446*b* that respectively rest on the pair of ledges 442*b* of the housing 406*b*.

Figure 15A:
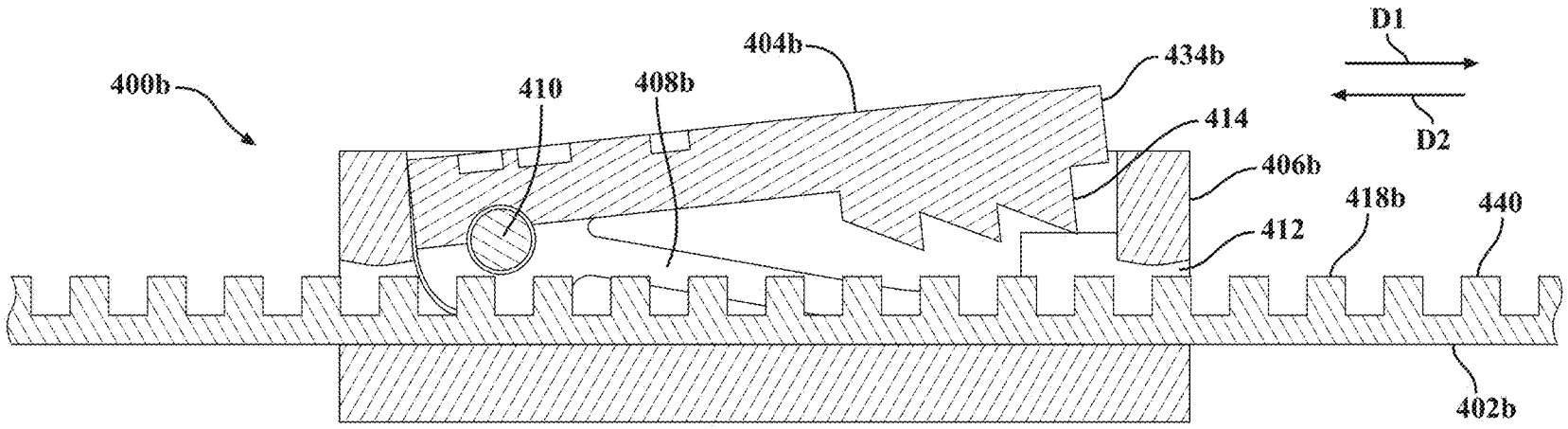
FIG. 15A is a cross-sectional view of the locking assembly of FIG. 12, taken along Line 15A-15A in FIG. 12, where the locking element is in the first configuration.
Figure 15B:
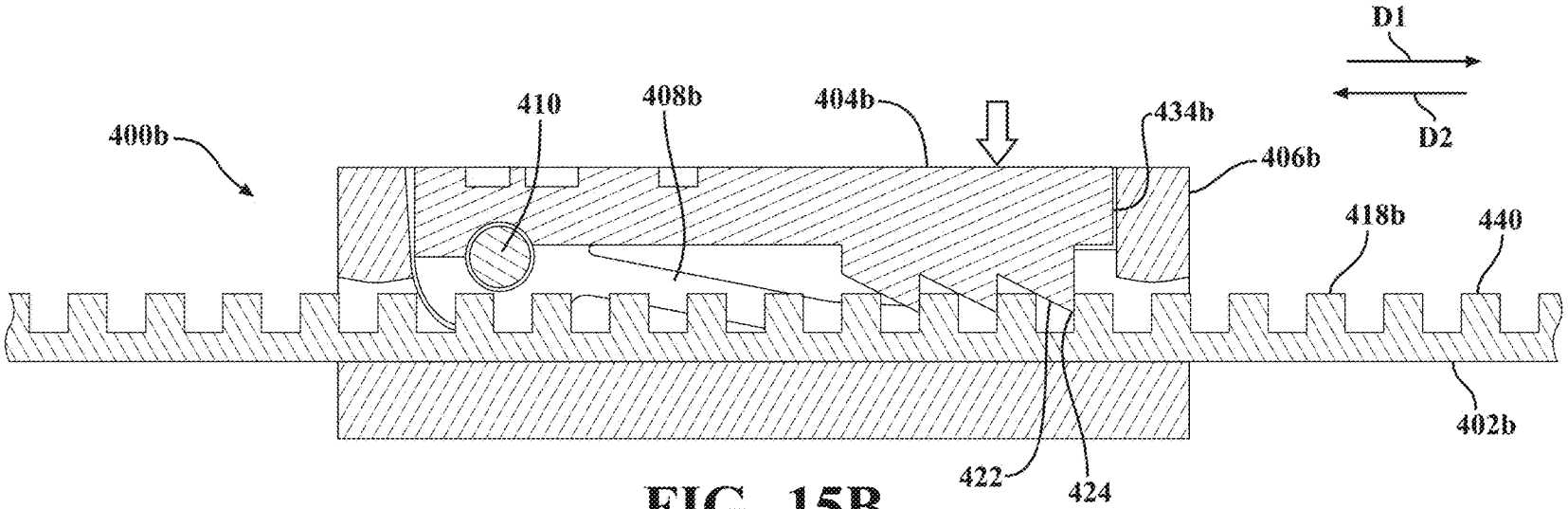
FIG. 15B is a cross-sectional view of the locking assembly of FIG. 12, where the locking element is in a second configuration.
Figure 16:
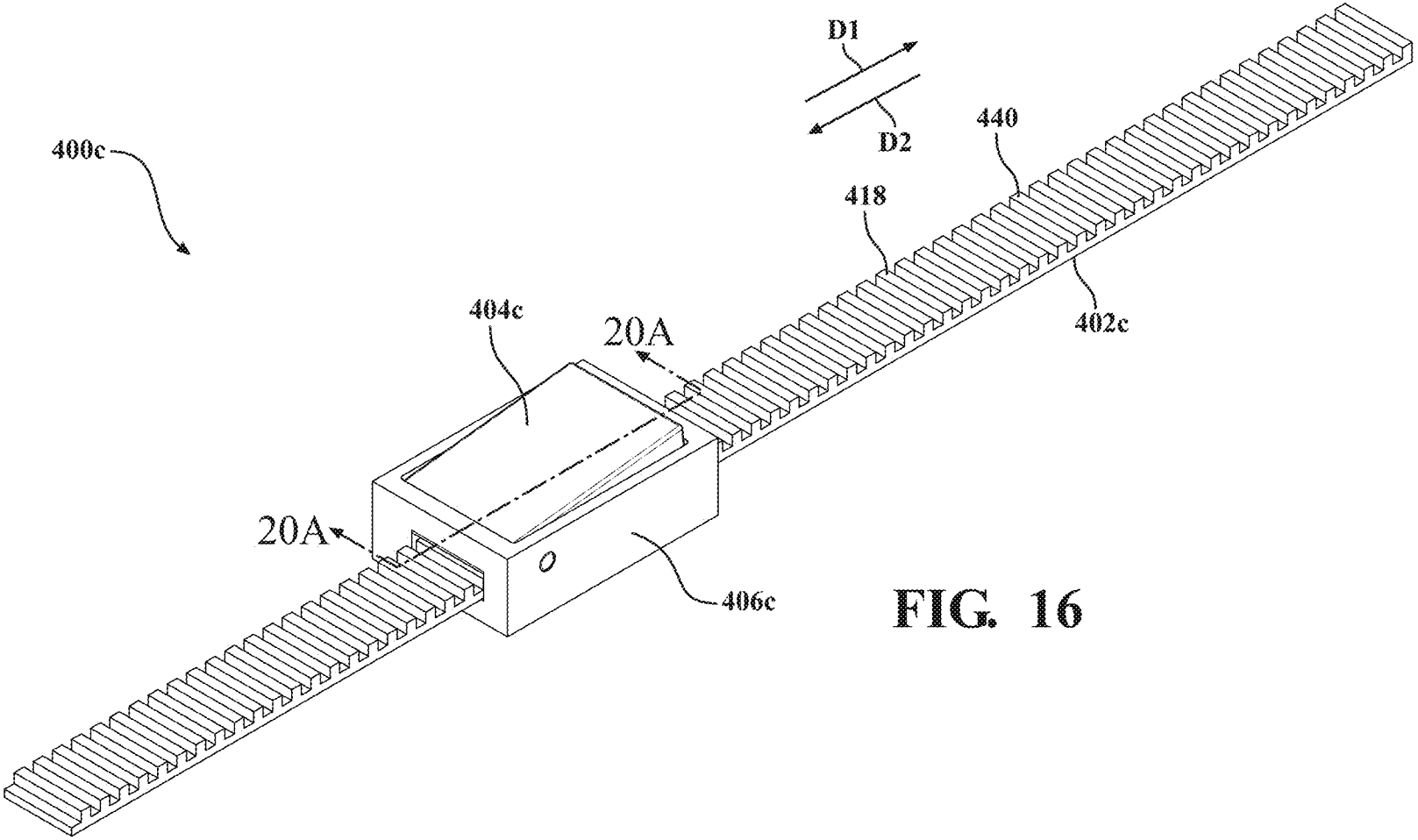
FIG. 16 is a perspective view of another example of a locking assembly according to the present disclosure, where a locking element is in a first configuration.
Figure 17:
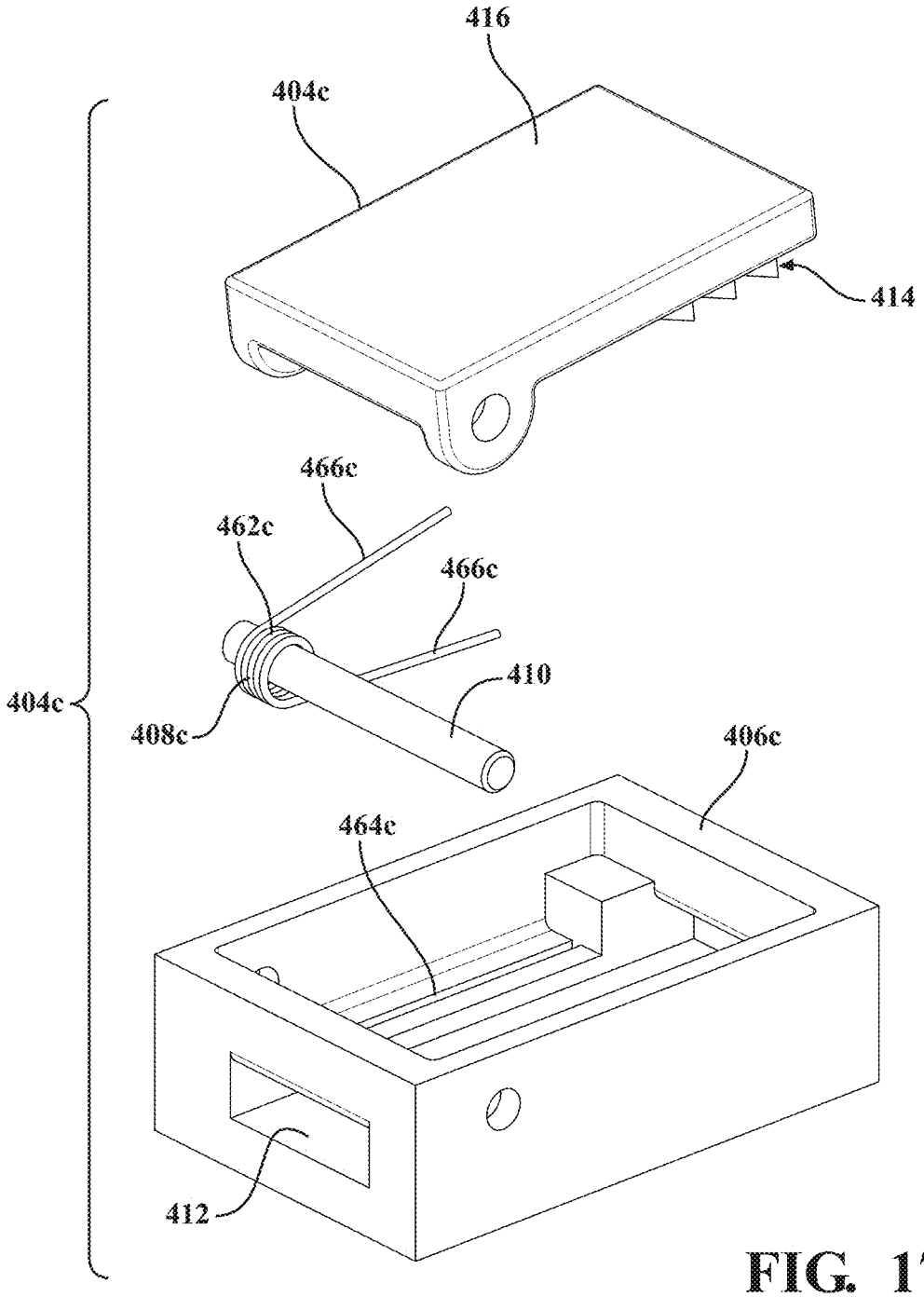
FIG. 17 is an exploded perspective view of the locking assembly of FIG. 16, where a biasing member is disposed between the locking element and a housing of the locking assembly.

As illustrated in FIGS. 15A and 15B, the body 416 of the locking element 404*b* is depressed toward the locking strip 402*b* when subjected to a force (i.e., in the direction of the arrow of FIG. 15B and in response to a vacuum being applied to the bladder 202), and the biasing member 408*b* is compressed. Stated differently, distal ends of the arms 444*b*, 446*b* of the biasing member 408*b* track along the ledges 442 of the housing 406*b* as the locking element 404*b* translates from the first configuration to the second configuration. The biasing member 408*b* of this example is configured as a living hinge, such that the biasing member 408*b* is integrally formed or otherwise formed as a unitary body with the body 416 of the locking element 404*b*. It is contemplated that the biasing member 408*b* may be formed via injection molding of the locking element 404*b*, such that each of the biasing members 408*b*, the body 416, and the engagement features 414 may be integrally formed from the same material. Alternatively, the engagement features 414 may be separately attached or coupled to the body 416, for example, via welding or other attachment methods.

Referring to FIGS. 15A and 15B, the engagement features 414 of the locking element 404*b* engage the teeth 440 of the locking strip 402*b* in a similar manner as described above with respect to FIGS. 10A and 10B. The engagement edges 424 of the engagement features 414 are disposed between the teeth 440 and engage the teeth 440 of the locking strip 402*b*. As similarly discussed above, the engagement features 414 prevent the locking strip 402*b* from moving in at least one direction, such that the engagement features 414 engage the teeth 440 of the interface surface 418 when the locking strip 402*b* is urged away from the housing 406*b* towards the expanded state in response to an external force. For example, during use, a foot may shift within the bootie 120 (FIG. 2B), such that a force is applied on the locking strip 402*b*. In this situation, the locking element 404*b* maintains the contracted state of the compressible component 300 by engaging the teeth 440 of the locking strip 402*b*. When the adjustable element 200*b* is under vacuum, the second end 434*b* of the locking element 404*b* has a greater moment of force applied to compress the biasing member 408*b* and generally lock the locking strip 402*b* via the engagement features 414. For example, the moment of force is depicted in FIG. 15B as an arrow applied downward on the second end 434*b* of the locking element 404*b*.

With particular reference to FIGS. 16-20B, another example of a locking assembly 400*c* incorporating the principles of the present disclosure is provided. In view of the substantial similarity in structure and function of the components associated with the locking assembly 400*c* with respect to the locking assembly 400*a*, like reference numerals are used hereinafter and in the drawings to identify like components while like reference numerals containing letter extensions are used to identify those components that have been modified.

Figure 18:
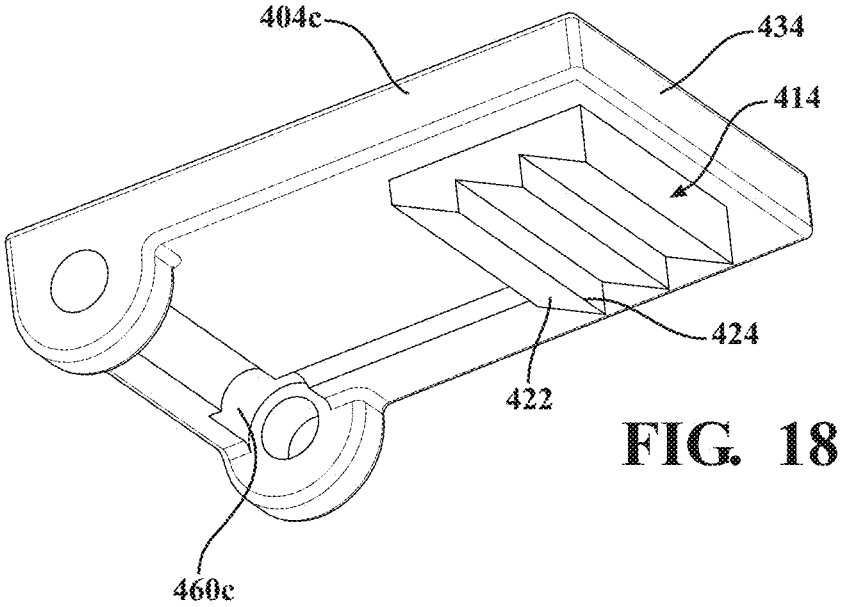
FIG. 18 is a bottom perspective view of the locking element of FIG. 16, where the locking element defines an arcuate recess.
Figure 19:
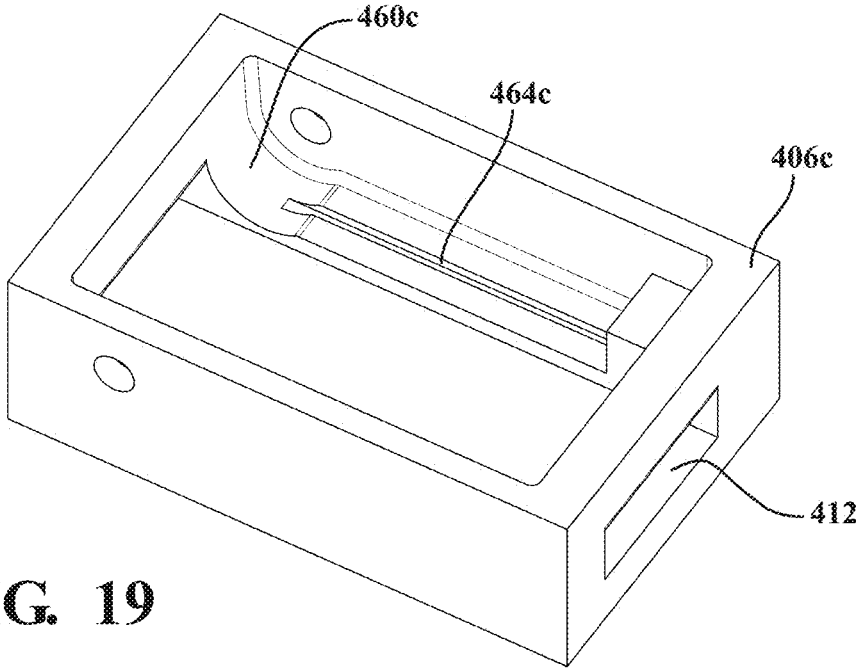
FIG. 19 is a top perspective view of the housing of the locking assembly of FIG. 16, where the housing defines a groove and an arcuate recess to receive the biasing member.

The locking assembly 400*c* is depicted with a locking strip 402*c* and a locking element 404*c* received within a housing 406*c*. The locking strip 402*c* includes the plurality of teeth 440 to define an interface surface 418*c*. A biasing member 408*c* is disposed between the locking element 404*c* and the housing 406*c*. The biasing member 408*c* is illustrated as a torsion spring that is disposed around the dowel 410. As illustrated in FIGS. 18 and 19, the body 416 of the locking element 404*c* and the housing 406*c* each define an arcuate recess 460*c* in which an attachment portion 462*c* of the biasing member 408*c* is positioned. Stated differently, the attachment portion 462*c* of the biasing member 408*c* is disposed around the dowel 410 and positioned within the arcuate recess 460*c* of each of the locking element 404*c* and the housing 406*c*. The housing 406*c* further defines a groove 464*c* in which at least one leg 466*c* of the biasing member 408*c* is positioned proximate to the locking element 404*c*.

Figure 20A:
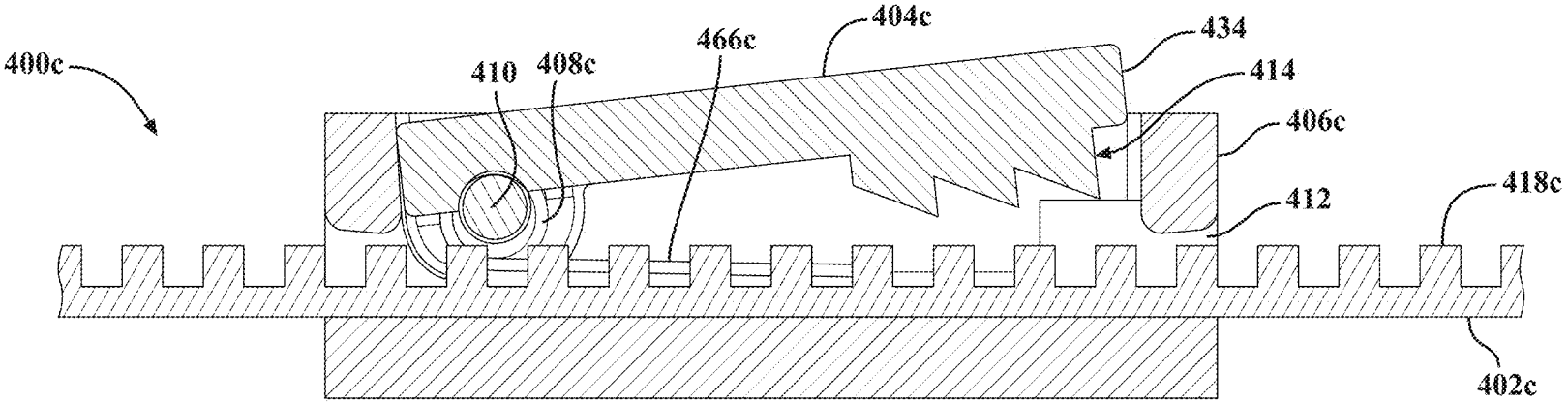
FIG. 20A is a cross-sectional view of the locking assembly of FIG. 16, taken along Line 20A-20A in FIG. 16, where the locking element is in the first configuration.
Figure 20B:
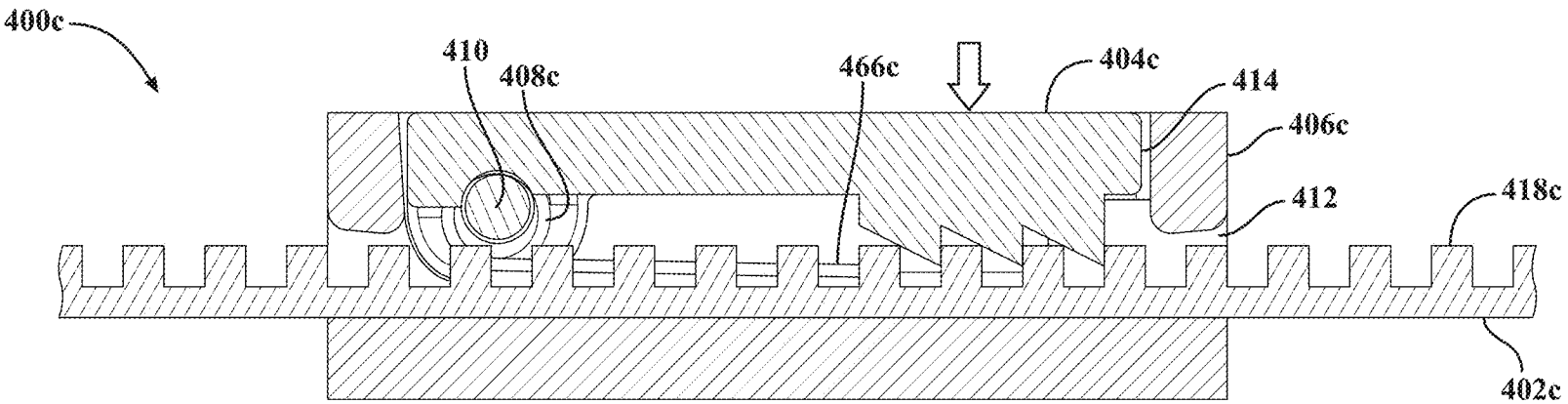
FIG. 20B is a cross-sectional view of the locking assembly of FIG. 16, where the locking element is in the second configuration.

As illustrated in FIGS. 20A and 20B, the body 416 of the locking element 404*c* may be biased away from the housing 406*c* in a similar manner as described above with respect to FIGS. 10A, 10B, 15A, and 15B. The legs 466*c* of the biasing member 408*c* are moved toward one another as the locking element 404*c* is compressed into the second configuration. As described above, the biasing member 408*c* biases the locking element 404*c* back to the first configuration (FIG. 20A) when the pressure within the interior void 204 (FIG. 3A) is increased. Thus, the locking assembly 400*c* operates in a similar manner as described above with respect to locking assemblies 400*a* and 400*b*. In any one of these configurations, the engagement features 414 engage the locking strip 402*a*, 402*b*, 402*c* to respectively retain the compressible component 300*a*, 300*b*, 300*c* in the contracted state. When the adjustable element 200*c* is under vacuum, a second end 434 of the locking element 404*c* moves toward the housing 406*c* and against the bias imparted on the locking element 404*c* by the biasing member 408*c* to lock the locking strip 402*c* via the engagement features 414. The applied force is depicted in FIG. 20B as an arrow applied downward on the second end 434 of the locking element 404*c*. The applied force is caused by the barrier layers 206*a*, 206*b* of the bladder 202 constricting and engaging the locking element 404*c*, thereby causing the locking element 404*c* to move into a locked state, as shown in FIG. 20B.

With particular reference to FIGS. 21-23B, a further example of a locking assembly 400*e* for an adjustable element 200*e* is provided. In this configuration, the locking assembly 400*e* includes a locking strip 402*e* disposed between a locking element 404*e* that includes first and second engagement features 414$e_1$, 414$e_2$ and at least one compressive element 430*e*. It is generally contemplated that the elastic element described herein may form a portion or an entirety of the locking strip 402*e*. The locking element 404*e* is connected to the locking strip 402*e* via a tether 405*e* coupled to a housing 406*e* of the locking element 404*e*. The engagement features 414$e_1$, 414$e_2$ may be coupled to the housing 406*e* via an adhesive 407*e* and/or other attachment features to secure the locking elements 414$e_1$, 414$e_2$ relative to the housing 406*e* in a locked state of the locking assembly 400*e*. The locking strip 402*e* extends through the housing 406*e* between the locking elements 414$e_1$, 414$e_2$ and may translate freely within the housing 406*e* in the unlocked state of the locking element 404*e*. The unlocked state of the locking element 404*e* is depicted by FIGS. 22A and 23A, such that the compressive element(s) 430*e* is expanded to define a space 426*e* between the engagement features 414$e_1$, 414$e_2$ and the locking strip 402*e*. As described above, an at least partial vacuum may be applied to the locking assembly 400*e*, such that a pressure within the interior void 204 may translate from a first pressure (i.e., at or above ambient pressure) to a second pressure (i.e., below ambient pressure). At the second pressure, the engagement features 414$e_1$, 414$e_2$ are biased together by the barrier layers 206*a*, 206*b*, and the compressive element 430*e* is compressed. A frictional force $F_F$ is defined between the engagement features 414$e_1$, 414$e_2$ along the locking strip 402*e*, such that the locking strip 402*e* is prevented from additional movement within the housing 406*e* of the locking assembly 400*e*. As the second pressure is defined, the locking strip 402*e* is translated to tighten or otherwise contract the bladder 202 about the wearer until a predefined minimum pressure is met. When the interior void 204 of the bladder 202 reaches the predefined minimum pressure, the frictional force $F_F$ applied on the locking strip 402*e* by the engagement features 414$e_1$, 414$e_2$ prevents any further movement or translation of the locking strip 402*e* relative to the housing 406*e*.

Figure 21:
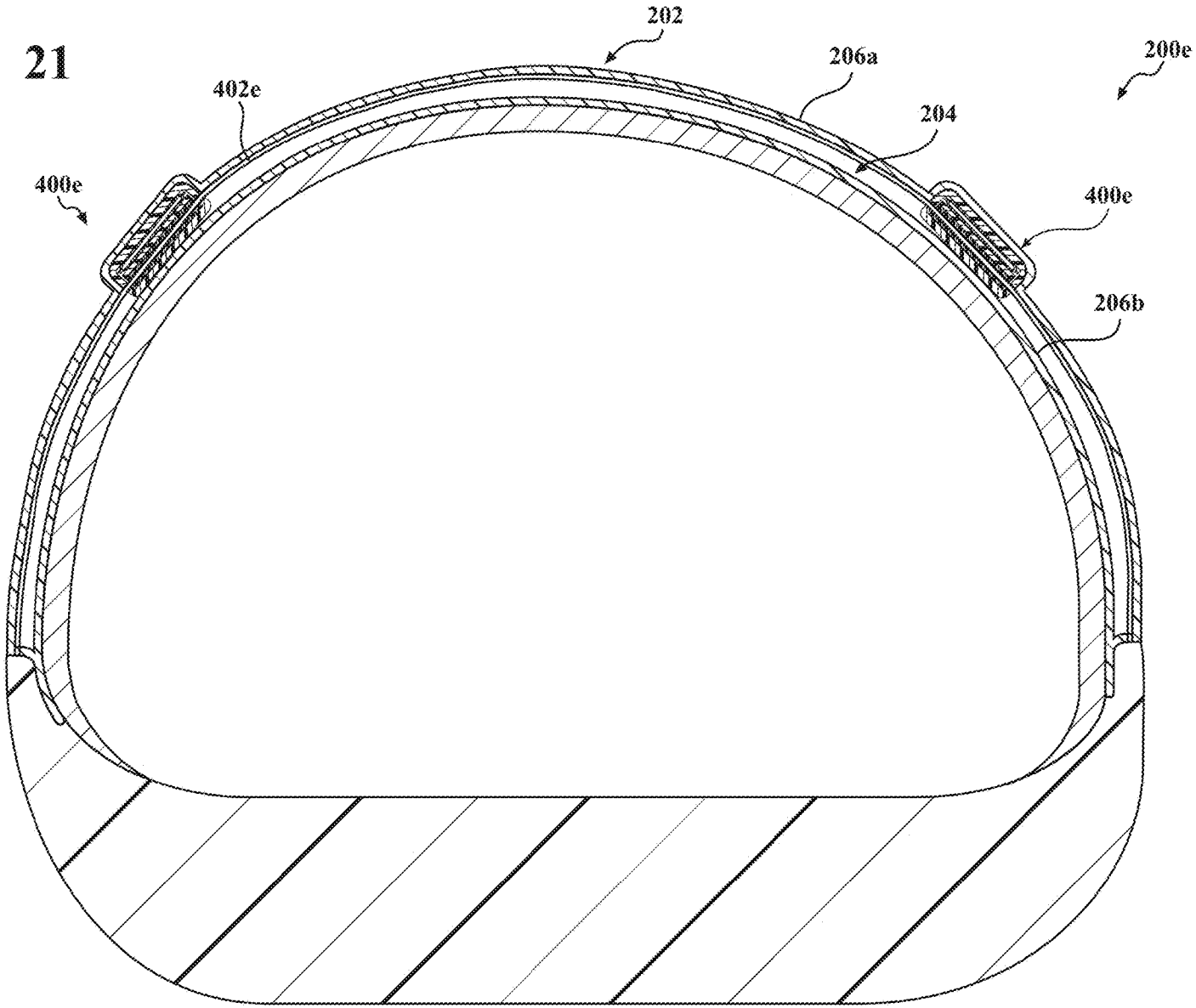
FIG. 21 is a cross-sectional view of a locking structure.
Figure 22A:
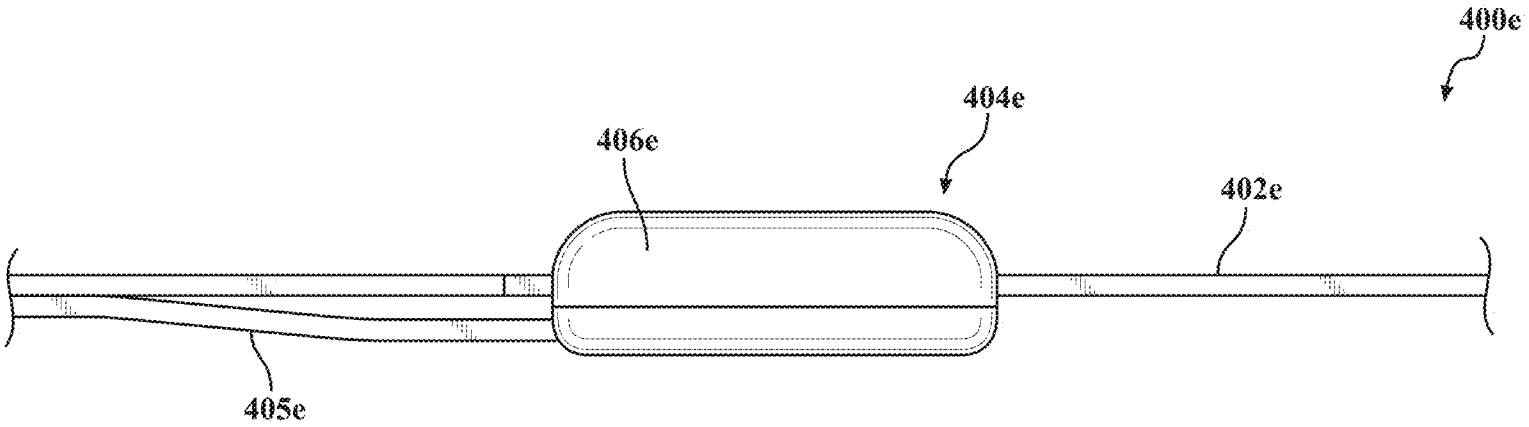
FIG. 22A is a partial enlarged elevational view of an example of a locking structure according to the present disclosure, where the locking structure is in an unlocked state.
Figure 22B:
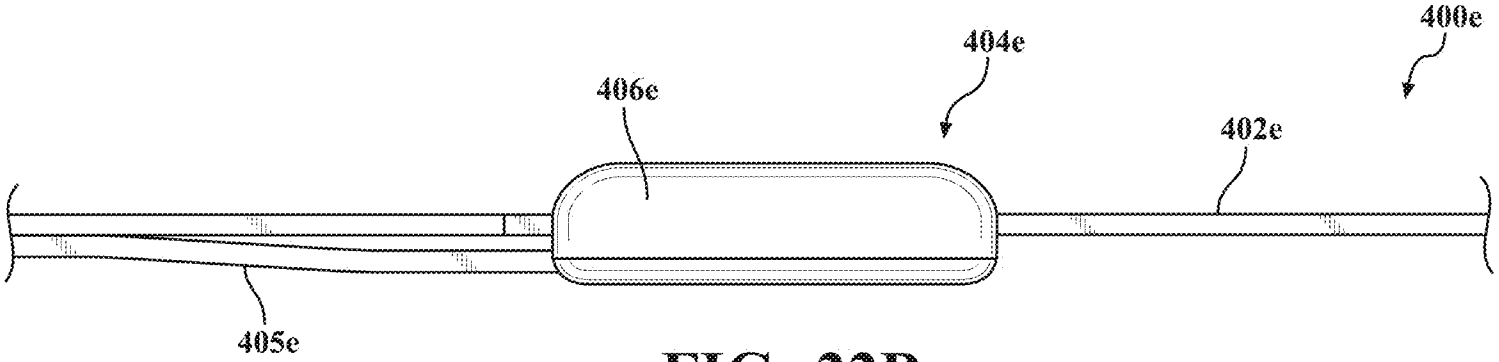
FIG. 22B is a partial enlarged elevational view of the locking structure of FIG. 22A, where the locking structure is in a locked state.
Figure 24A:
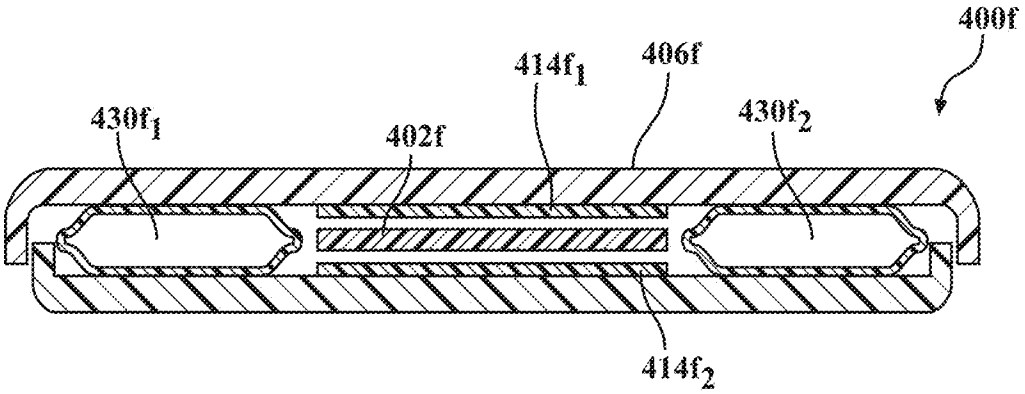
FIG. 24A is a cross-sectional view of an example of a locking structure according to the present disclosure, where the locking structure is in an unlocked state.
Figure 24B:
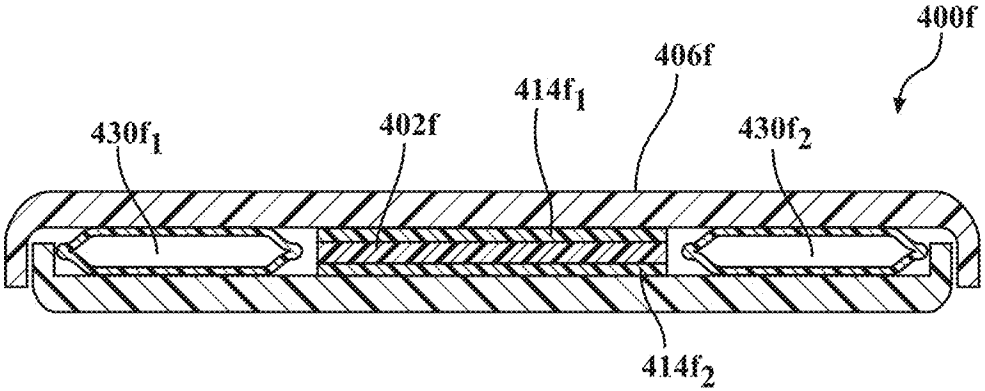
FIG. 24B is a cross-sectional view of the locking structure of FIG. 24A, where the locking structure is in a locked state

In one example, illustrated in FIGS. 24A and 24B, a locking element 404*f* includes first and second compressive elements 430$f_1$, 430$f_2$ that compress under the second pressure defined within the interior void 204 (FIG. 21). In this configuration, engagement features 414$f_1$, 414$f_2$ are centrally disposed between the compressive elements 430$f_1$, 430$f_2$ within a housing 406*f*. The first and second compressive elements 430$f_1$, 430$f_2$ may assist in providing even compression across the locking element 404*f*. For example, utilizing multiple compressive elements 430$f_1$, 430$f_2$ may assist in following a contour of the wearer's body, such as foot structure and/or torso structure, such that the first and second compressive elements 430$f_1$, 430$f_2$ may compress at variable rates. In this example, the locking element 404*f* may be aligned along the wearer's body in a manner that presents an uneven alignment of the first and second compressive elements 430$f_1$, 430$f_2$, and the utilization of the first and second compressive elements 430$f_1$, 430$f_2$ may maximize the compression and stabilization of the locking element 404*f* relative to the wearer. As illustrated in FIG. 24B, the first and second compressive elements 430$f_1$, 430$f_2$ are generally equally compressed and define the locked state of the engagement features 414$f_1$, 414$f_2$ about a locking strip 402*f*.

Figure 25:
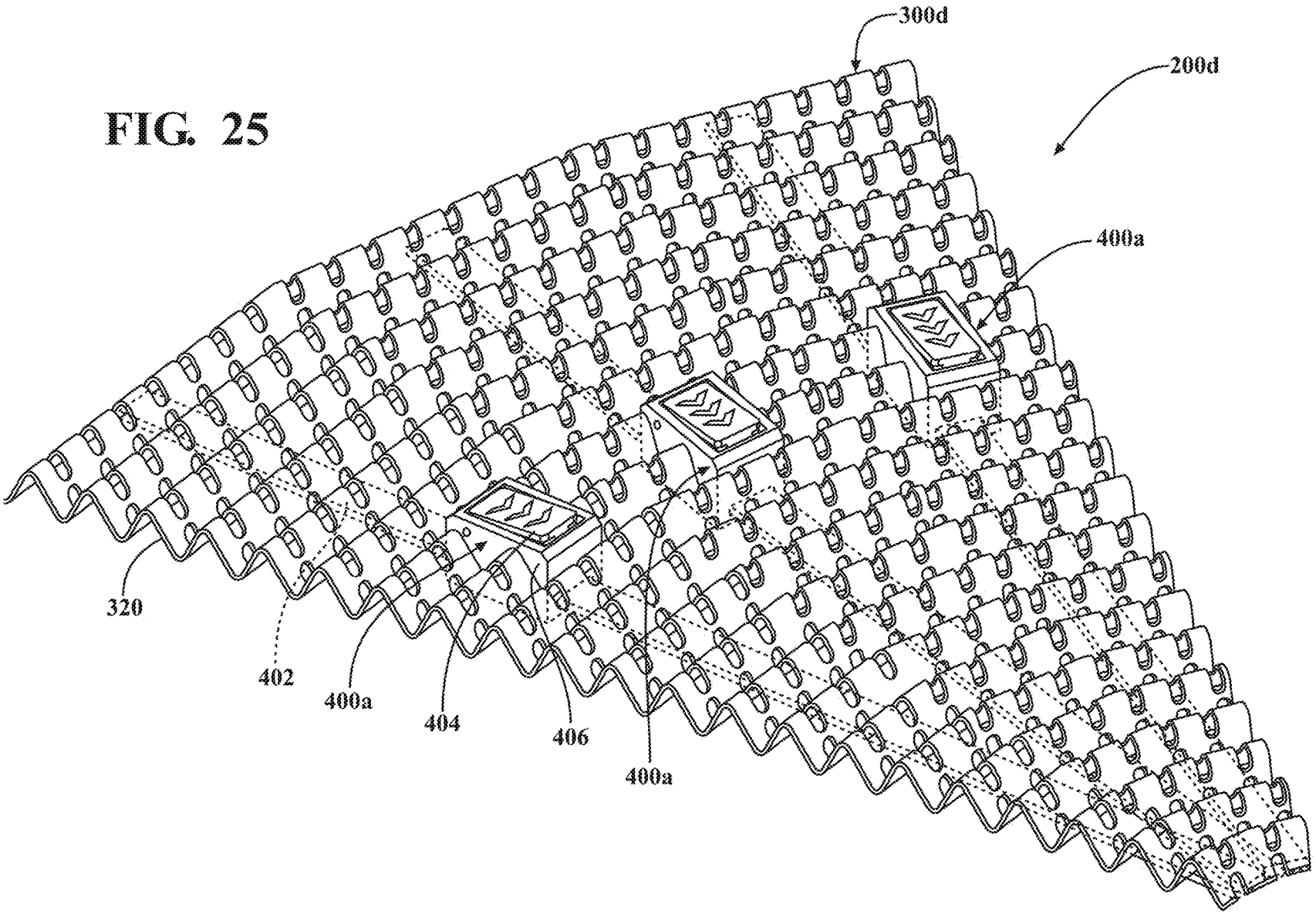
FIG. 25 is a perspective view of a compressible component in accordance with the present disclosure for use in conjunction with an adjustable element.
Figure 26A:
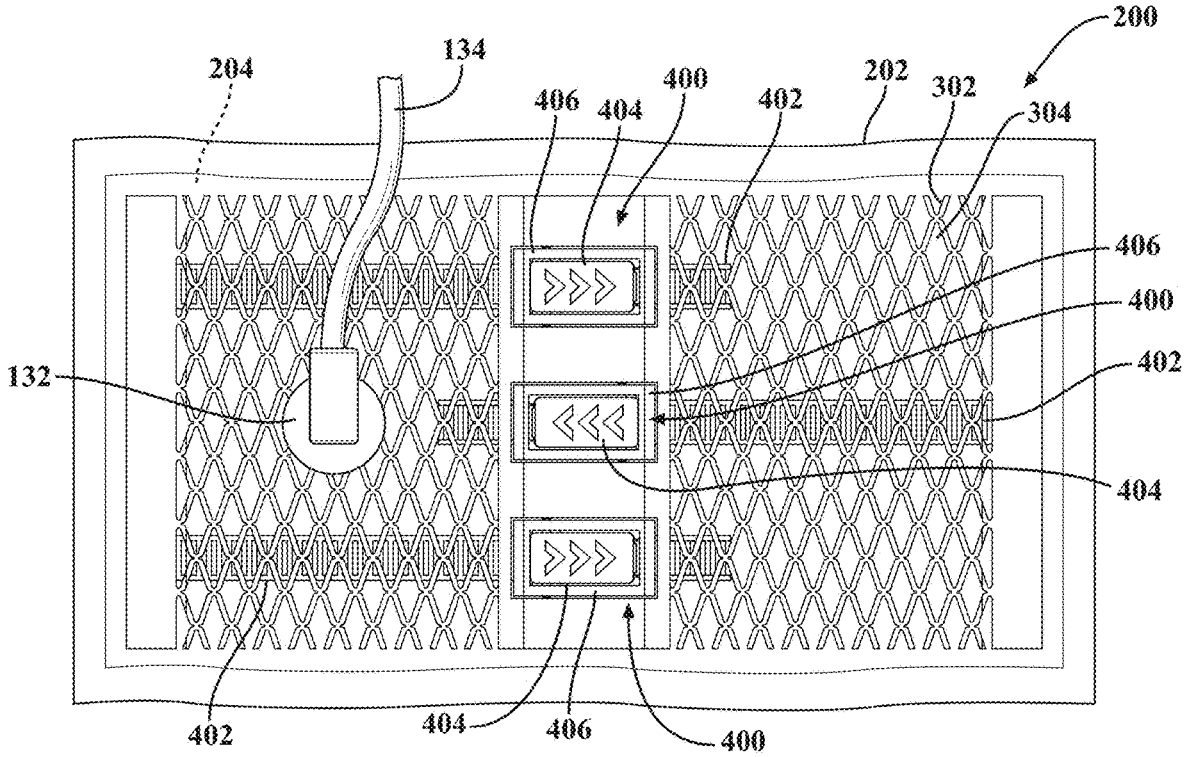
FIG. 26A is a perspective view of an example of an adjustable element according to the present disclosure, where a compressible component has a corrugated structure and is in a relaxed state.
Figure 26B:
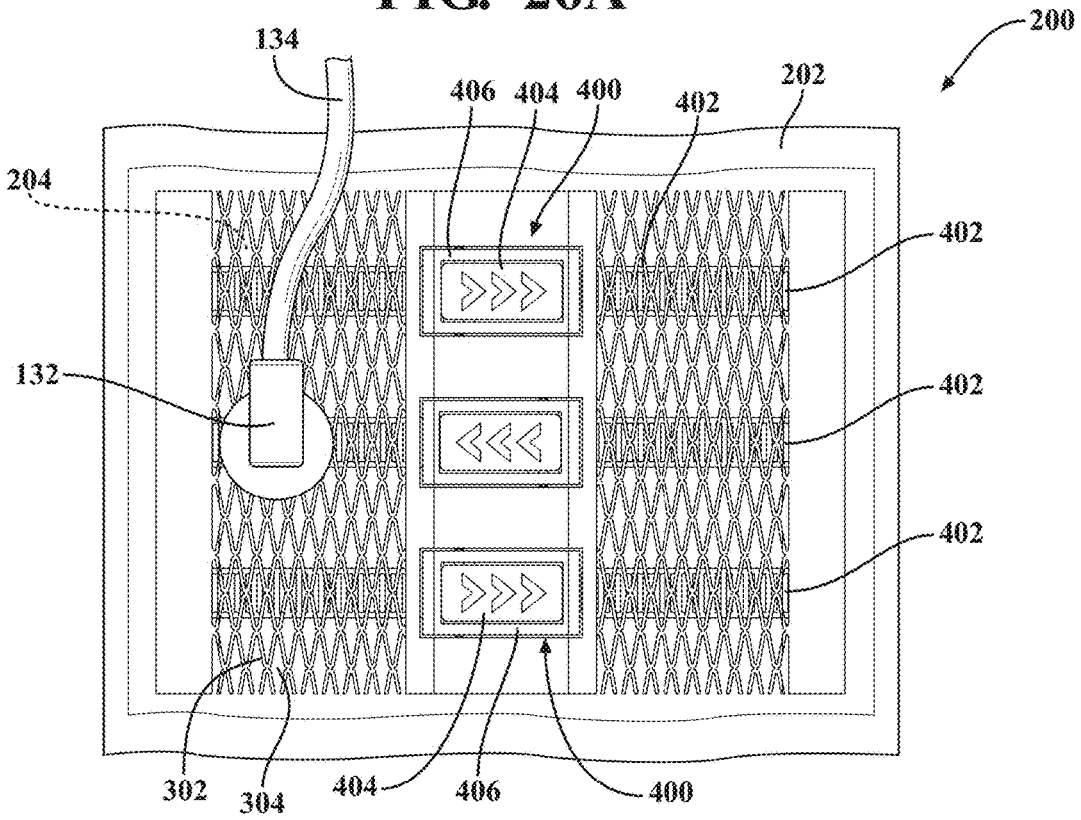
FIG. 26B is a perspective view of the adjustable element of FIG. 26A where the adjustable element is in a contracted state.
Figure 27A:
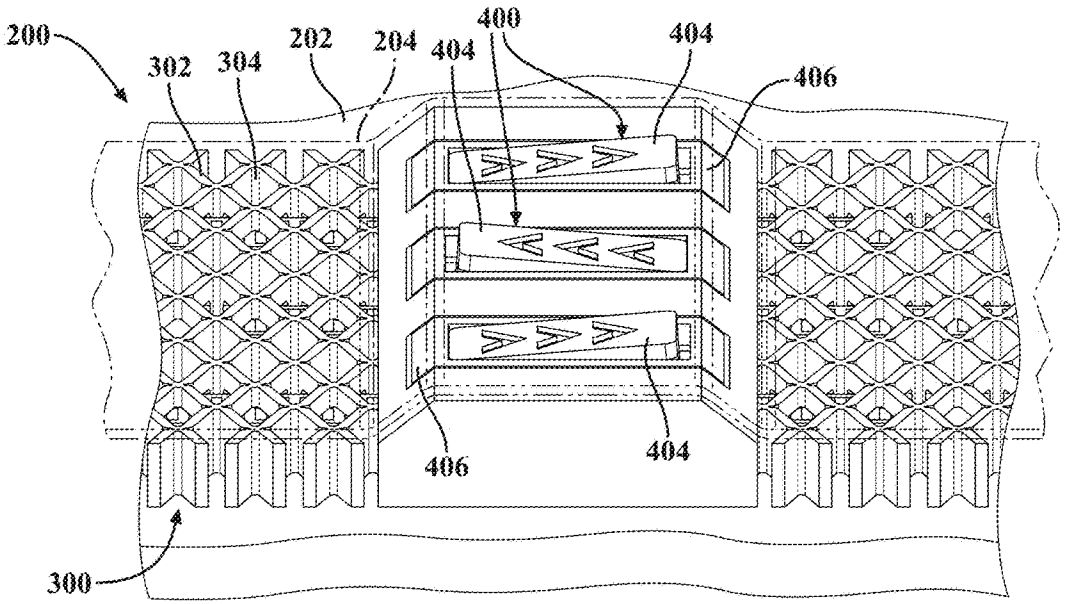
FIG. 27A is a plan view of another example of an adjustable element for an article of footwear according to the present disclosure, where the adjustable element is in a relaxed state.
Figure 27B:
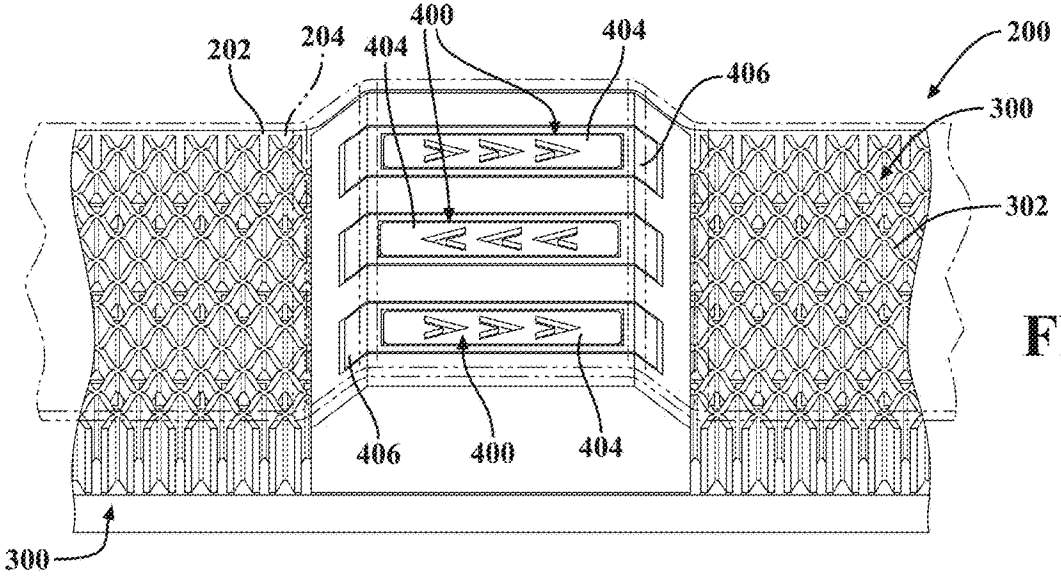
FIG. 27B is a plan view of the adjustable assembly of FIG. 27A, where the adjustable element is in a contracted state.

With particular reference to FIG. 25, another example of an adjustable element 200*d* incorporating the principles of the present disclosure is provided. In view of the substantial similarity in structure and function of the components associated with the adjustable element 200*d* with respect to the adjustable element 200*a*, like reference numerals are used hereinafter and in the drawings to identify like components while like reference numerals containing letter extensions are used to identify those components that have been modified.

A compressible component 300*d* may be configured with a corrugated profile including a plurality of waves or ridges 320, as illustrated in FIG. 25. The adjustable element 200*d* illustrated in FIG. 25 may be integrated with the ridges 320, such that the locking assemblies 400*a* may be positioned at various locations along the compressible component 300*d*.

Figure 23A:
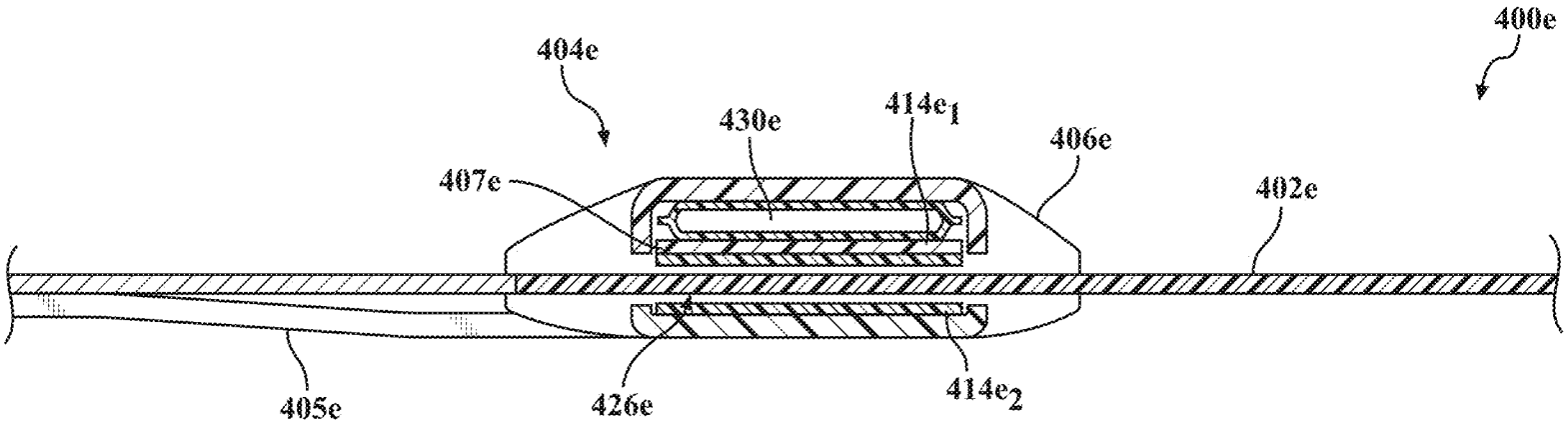
FIG. 23A is a cross-sectional view of the locking structure of FIG. 22A, where the locking structure is in an unlocked state.
Figure 23B:
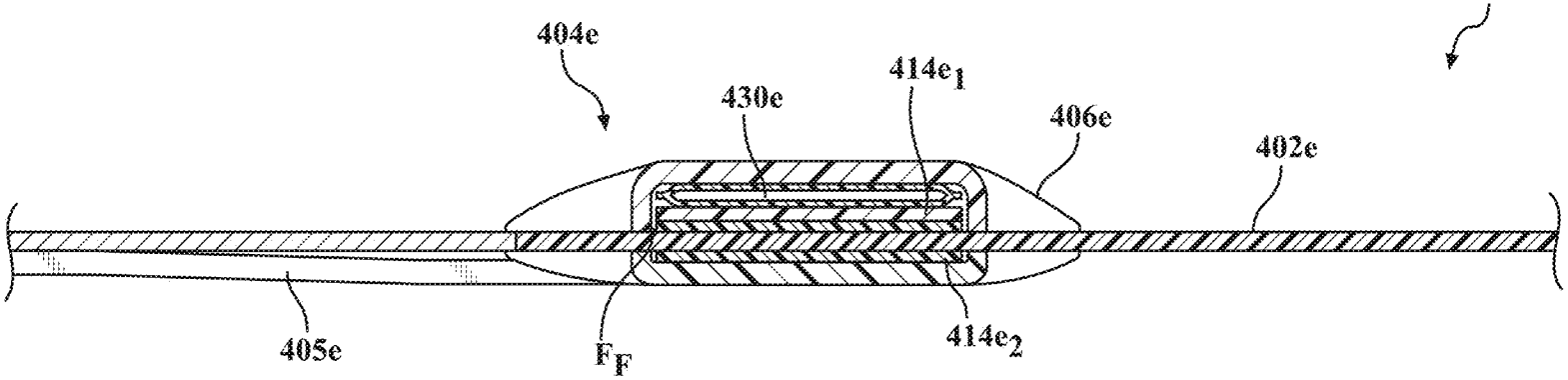
FIG. 23B is a cross-sectional view of the locking structure of FIG. 22B, where the locking structure is in a locked state.

Referring now to FIGS. 26A-27B, a generic example of an adjustable element is provided according the principles of the present disclosure. The adjustable element 200 illustrated in FIGS. 26A-27B may incorporate any one of the adjustable elements 200*a*-200*c*, compressible components 300*a*-300$f_2$, and/or locking assemblies 400*a*-400*f*, as described herein in any combination. The adjustable element 200 is illustrated in the relaxed or expanded state (FIG. 26A) and the contracted state (FIG. 26B). The pressure source 130 may be activated to define at least a partial vacuum within the interior void 204 of the bladder 202. The at least partial vacuum results in a decrease in pressure within the interior void 204, which constricts or otherwise contracts the compressible component 300. For example, the illustrated compressible component 300 includes the lattice structure 302 that can contract resulting in a decreased size of the reliefs 304. The locking strip 402 of the locking assembly 400 is disposed within the lattice structure 302 of the compressible component 300 and is coupled to at least one end 224 of the adjustable element 200. As illustrated in FIG. 23B, the locking element 404 is pressed downward as a result of the restricted decreased pressure defined by the pressure source 130, and the engagement features 414 engage with the interface surface 418 of the locking strip 402 (FIGS. 10B, 15B, and 20B).

The engagement edges 424 of the locking element 404 retain the locking strip 402 and, thus, the compressible component 300 in the contracted state (FIGS. 26B and 27B) via engagement with the interface surface 418 of the locking strip 402. It is contemplated that an additional vacuum may be applied to the interior void 204 of the bladder 202 to further decrease the pressure, as generally mentioned above. In this state, the compressible component 300 may be further compressed, such that the locking strip 402 may translate a greater distance within the housing 406. The interface surface 418 may pass in the first direction $D_1$ beneath the engagement features 414 along the angled surfaces 422 of the locking element 404, and the locking strip 402 may be restricted from moving in an opposing direction again by the engagement edges 424 of the locking element 404. Once the pressure is increased within the interior void 204, the end 434 of the locking element 404 may be released, and the biasing member 408 will bias the engagement features 414 away from the interface surface 418 of the locking strip. Stated differently, the locking element 404 is biased from the second configuration with the engagement features 414 engaged with the interface surface 418 of the locking strip 402 to the first configuration with the engagement features 414 disengaged from the interface surface 418 of the locking strip 402.

The adjustable element 200 provides a compressive force that assists in the upper 100 conforming to the foot of the wearer. The compressive fit of the upper 100 against the foot of the wearer advantageously provides added support during wear and assists in stabilizing movement of the foot and/or ankle. For example, the foot and/or ankle are stabilized by the adjustable element 200 and the upper 100 during lateral movements. Further, the variable pressure pump 130 can continue to draw the at least partial vacuum during wear until a threshold pressure is achieved. Thus, as the wearer increases in activity, the more stabilized the upper 100 becomes as a result of the compressive force. Once the wearer is ready to remove the footwear 10, the user can release the pressure of the adjustable element to remove the footwear 10.

The following Clauses provide an exemplary configuration for an adjustable element for an article of footwear described above.

Clause 1. An adjustable element includes a bladder defining an interior void, a compressible component disposed within the interior void and operable between an expanded state and a contracted state, a lock strip including a first end anchored at a first location within the bladder and a second end disposed at an opposite end of the lock strip than the first end, and a lock receiving the lock strip and operable between a locked state restricting movement of the lock strip relative to the bladder and an unlocked state permitting movement of the lock strip relative to the bladder.

Clause 2. The adjustable element of Clause 1, wherein the compressible component includes a passageway extending therethrough, the lock strip slidably received by the passageway.

Clause 3. The adjustable element of either of Clause 1 or Clause 2, wherein the compressible component is formed from foam.

Clause 4. The adjustable element of any of the preceding Clauses, wherein the lock strip includes a longitudinal axis extending between the first end and the second end, the compressible component moving along the longitudinal axis when moving between the expanded state and the contracted state.

Clause 5. The adjustable element of any of the preceding Clauses, wherein the lock strip includes a first side and a second side formed on an opposite side of the lock strip than the first side, the first side including a first series of engagement features operable to engage the lock in the locked state.

Clause 6. The adjustable element of Clause 5, wherein the lock includes a second series of engagement features operable to engage the first series of engagement features in the locked state and/or the lock is biased into the locked state by a biasing member.

Clause 7. The adjustable element of any of the preceding Clauses, wherein the compressible component is moved from the expanded state to the contracted state by removing fluid from the interior void.

Clause 8. The adjustable element of any of the preceding Clauses, wherein the lock is fixed relative to the bladder at a second location spaced apart from the first location.

Clause 9. The adjustable element of Clause 8, wherein an effective length of the lock strip is reduced between the first location and the second location when the compressible component is moved from the expanded state to the contracted state.

Clause 10. An article of footwear incorporating the adjustable element of any of the preceding Clauses.

Clause 11. An adjustable element including a bladder defining an interior void, a compressible component disposed within the interior void and operable between an expanded state and a contracted state, a lock strip including a first end anchored at a first location within the bladder and a second end disposed at an opposite end of the lock strip than the first end, and a lock fixed relative to the bladder at a second location spaced apart from the first location and receiving the lock strip, the lock operable to selectively fix a position of the lock strip relative to the bladder in a locked state when the compressible component is moved into the contracted state.

Clause 12. The adjustable element of Clause 11, wherein the compressible component includes a passageway extending therethrough, the lock strip slidably received by the passageway.

Clause 13. The adjustable element of either of Clauses 11 or 12, wherein the compressible component is formed from foam.

Clause 14. The adjustable element of any of the preceding Clauses, wherein the lock strip includes a longitudinal axis extending between the first end and the second end, the compressible component moving along the longitudinal axis when moving between the expanded state and the contracted state.

Clause 15. The adjustable element of any of the preceding Clauses, wherein the lock strip includes a first side and a second side formed on an opposite side of the lock strip than the first side, the first side including a first series of engagement features operable to engage the lock in the locked state.

Clause 16. The adjustable element of Clause 15, wherein the lock includes a second series of engagement features operable to engage the first series of engagement features in the locked state and/or the lock is biased into the locked state by a biasing member.

Clause 17. The adjustable element of any of the preceding Clauses, wherein the lock is rotatable relative to the bladder.

Clause 18. The adjustable element of any of the preceding Clauses, wherein the compressible component is moved from the expanded state to the contracted state by removing fluid from the interior void.

Clause 19. The adjustable element of any of the preceding Clauses, wherein an effective length of the lock strip is reduced between the first location and the second location when the compressible component is moved from the expanded state to the contracted state.

Clause 20. An article of footwear incorporating the adjustable element of any of the preceding Clauses.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An adjustable element for an article of footwear, the adjustable element comprising:

a bladder defining an interior void;

a compressible component including a lattice structure disposed within the interior void and operable between an expanded state and a contracted state;

a lock strip including a first end anchored at a first location within the bladder and a second end disposed at an opposite end of the lock strip than the first end; and a lock receiving the lock strip and operable between a locked state restricting movement of the lock strip relative to the bladder and an unlocked state permitting movement of the lock strip relative to the bladder.

2. The adjustable element of claim 1, wherein the compressible component includes a passageway extending therethrough, the lock strip slidably received by the passageway.

3. The adjustable element of claim 1, wherein the compressible component is formed from foam.

4. The adjustable element of claim 1, wherein the lock strip includes a longitudinal axis extending between the first end and the second end, the compressible component moving along the longitudinal axis when moving between the expanded state and the contracted state.

5. The adjustable element of claim 1, wherein the lock strip includes a first side and a second side formed on an opposite side of the lock strip than the first side, the first side including a first series of engagement features operable to engage the lock in the locked state.

6. The adjustable element of claim 5, wherein (i) the lock includes a second series of engagement features operable to engage the first series of engagement features in the locked state and/or (ii) the lock is biased into the locked state by a biasing member.

7. The adjustable element of claim 1, wherein the compressible component is moved from the expanded state to the contracted state by removing fluid from the interior void.

8. The adjustable element of claim 1, wherein the lock is fixed relative to the bladder at a second location spaced apart from the first location.

9. The adjustable element of claim 8, wherein a length of the lock strip disposed between the first location and the second location is reduced when the compressible component is moved from the expanded state to the contracted state.

10. An article of footwear incorporating the adjustable element of claim 1.

11. An adjustable element for an article of footwear, the adjustable element comprising:

a bladder defining an interior void;

a compressible component including a lattice structure disposed within the interior void and operable between an expanded state and a contracted state;

a lock strip including a first end anchored at a first location within the bladder and a second end disposed at an opposite end of the lock strip than the first end; and a lock fixed relative to the bladder at a second location spaced apart from the first location and receiving the lock strip, the lock operable to selectively fix a position of the lock strip relative to the bladder in a locked state when the compressible component is moved into the contracted state.

12. The adjustable element of claim 11, wherein the compressible component includes a passageway extending therethrough, the lock strip slidably received by the passageway.

13. The adjustable element of claim 11, wherein the compressible component is formed from foam.

14. The adjustable element of claim 11, wherein the lock strip includes a longitudinal axis extending between the first end and the second end, the compressible component moving along the longitudinal axis when moving between the expanded state and the contracted state.

15. The adjustable element of claim 11, wherein the lock strip includes a first side and a second side formed on an opposite side of the lock strip than the first side, the first side including a first series of engagement features operable to engage the lock in the locked state.

16. The adjustable element of claim 15, wherein (i) the lock includes a second series of engagement features operable to engage the first series of engagement features in the locked state and/or (ii) the lock is biased into the locked state by a biasing member.

17. The adjustable element of claim 11, wherein the lock is rotatable relative to the bladder.

18. The adjustable element of claim 11, wherein the compressible component is moved from the expanded state to the contracted state by removing fluid from the interior void.

19. The adjustable element of claim 11, wherein a length of the lock strip disposed between the first location and the second location is reduced when the compressible component is moved from the expanded state to the contracted state.

20. An article of footwear incorporating the adjustable element of claim 11.

* * * * *